US007537322B2

(12) United States Patent
Ishikawa et al.

(10) Patent No.: US 7,537,322 B2
(45) Date of Patent: May 26, 2009

(54) IMAGE RECORDING APPARATUS

(75) Inventors: Kan Ishikawa, Toyoake (JP); Daisuke Kozaki, Nagoya (JP); Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 271 days.

(21) Appl. No.: 11/071,315

(22) Filed: Mar. 4, 2005

(65) Prior Publication Data

US 2005/0195252 A1 Sep. 8, 2005

(30) Foreign Application Priority Data

Mar. 5, 2004 (JP) ..... 2004-062611
Mar. 8, 2004 (JP) ..... 2004-064631

(51) Int. Cl.
*B41J 2/175* (2006.01)

(52) U.S. Cl. ..... 347/85

(58) Field of Classification Search ..... 347/16, 347/32, 84, 85, 101, 104
See application file for complete search history.

(56) References Cited

U.S. PATENT DOCUMENTS 4,383,263 A * 5/1983 Ozawa et al. ..... 347/30
4,526,486 A 7/1985 Kikuchi et al.
5,043,746 A * 8/1991 Abe ..... 347/85
5,185,615 A * 2/1993 Koitabashi et al. ..... 347/35
5,408,257 A * 4/1995 Hiramatsu et al. ..... 347/92
5,469,201 A * 11/1995 Erickson et al. ..... 347/85
5,473,354 A * 12/1995 Arquilevich et al. ..... 347/85
6,007,190 A 12/1999 Murray et al.
6,012,796 A * 1/2000 Tanaka ..... 347/15
6,068,370 A * 5/2000 Miller et al. ..... 347/85
6,168,268 B1 * 1/2001 Sugiyama ..... 347/89
6,247,802 B1 6/2001 Gasso
6,559,973 B2 5/2003 Bullock et al.

(Continued)

FOREIGN PATENT DOCUMENTS

JP 59143667 8/1984

(Continued)

OTHER PUBLICATIONS

Chinese Patent Office Action for Chinese Patent Application No. 200510053140.6.

(Continued)

*Primary Examiner*—Anh T. N. Vo
(74) *Attorney, Agent, or Firm*—Banner & Witcoff, Ltd

(57) ABSTRACT

An image recording apparatus includes a recording apparatus body, a carriage having joint portions, a recording head mounted on the carriage, an ink storage disposed in the recording apparatus body in a stationary state, an intermediate fixing portion provided in the recording apparatus body between the ink storage and the carriage, and ink supply tubes for supplying ink from the ink storage to the recording head. The ink supply tubes are fixed to the intermediate fixing portion and independently disposed between the intermediate fixing portion and the carriage. Midsections of the ink supply tubes are bent between a route of the carriage and the intermediate fixing portion. A direction of arrangement of the tubes at the midsections thereof extending toward the intermediate fixing portion and a direction of arrangement of the tubes at the midsections thereof extending toward the joint portions of the carriage are differentiated.

32 Claims, 21 Drawing Sheets

U.S. PATENT DOCUMENTS

| | | | | |
|---|---|---|---|---|
| 6,572,211 | B2 * | 6/2003 | Ootsubo et al. | 347/16 |
| 6,582,067 | B2 | 6/2003 | Matsuzaki et al. | |
| 6,726,316 | B2 | 4/2004 | Shimizu | |
| 6,755,514 | B2 | 6/2004 | Koga | |
| 6,789,882 | B2 | 9/2004 | Hiramatsu et al. | |
| 6,834,945 | B2 * | 12/2004 | Ishizawa et al. | 347/86 |
| 7,040,745 | B2 * | 5/2006 | Kent | 347/89 |
| 7,052,115 | B2 * | 5/2006 | Sekiya | 347/57 |
| 2001/0026304 | A1 | 10/2001 | Matsuzaki et al. | |
| 2002/0126180 | A1 | 9/2002 | Hiramatsu et al. | |

FOREIGN PATENT DOCUMENTS

| | | | |
|---|---|---|---|
| JP | 2-4562 | | 1/1990 |
| JP | 02-004562 | | 1/1990 |
| JP | 2002-321351 | A | 11/2002 |
| JP | 2003048353 | | 2/2003 |
| JP | 2003-136698 | A | 5/2003 |
| JP | 2003-175589 | A | 6/2003 |
| JP | 2004034513 | | 2/2004 |

OTHER PUBLICATIONS

Notification of Reason for Refusal dated Feb. 26, 2008 in Application No. JP2003-134000 and English translation thereof.

Japanese Office Action, Patent Application No. 2004-064631, Dated Oct. 29, 2008.

* cited by examiner

IMAGE RECORDING APPARATUS

BACKGROUND OF THE INVENTION

1. Field of the Invention

The present invention relates to an inkjet image recording apparatus which is capable of recording in color and, more specifically, to an arrangement structure of a plurality of flexible ink supply tubes for supplying ink to a reciprocating recording head from an ink storage such as an ink cartridge mounted at a stationary position in an image recording apparatus body.

2. Description of the Related Art

In the related art, an inkjet printer in which an ink storage and a recording head is connected by a plurality of flexible ink supply tubes, and ink is supplied from the ink storage to the recording head for recording an image is proposed. In such an inkjet printer, the plurality of ink supply tubes are bundles by a tube band at midsections thereof (the midsections between the ink storage and the recording head) so that the midsections of the respective ink supply tubes are prevented from moving separately. For example, in JP-A-2003-175588 (see FIG. 1 to FIG. 7), a recording unit in which a carriage having a recording head mounted thereon is capable of reciprocating substantially in a horizontal direction orthogonal to a transporting (discharging) direction of paper (recording medium) is provided on the backside of a recording apparatus body. The recorded paper is discharged out from a paper discharging port at the front end of the recording apparatus body. Two ink supply tubes each are bundled at the midsections thereof by the tube bands out of four ink supply tubes for supplying ink from a color ink cassettes disposed in a stationary state in the recording apparatus body to the recording head. The distal ends of one of the pairs of bundled ink supply tubes are connected to one side of the recording head, and the other pair of ink supply tubes are connected to the other side of the recording head. Then, the midsections of the bundled ink supply tubes are restrained from coming apart in random order when they are bent (sagged) into a U-shape when viewed in plan view in accordance with the reciprocal movement of the carriage.

On the other hand, in JP-A-2002-321351 (see FIG. 4 and FIG. 5), a four-tube plate including four flexible ink supply tubes arranged in rows in the vertical direction and joined together, which is provided with flexibility in the direction of thickness of the plate is provided.

In an inkjet printer in the related art, an ink storage for storing ink is provided separately from a recording head to supply the ink to the recording head from this ink storage via tubes. In this structure, in comparison with the structure in which the ink storage is integrally provided on the recording head, the recording head can easily be downsized. When such a structure is employed to a serial type inkjet printer, the recording head can be downsized to reduce a load exerted to a carriage motor, and the carriage motor can also be downsized.

When the ink is supplied to the recording head from the ink storage via the tubes, there are considerable methods of attaching the tubes to the recording head includes a method of providing the tubes so as to project from an upper surface (a surface opposite from a platen) of the recording head and a method of providing the tubes so as to project from an end surface of the recording head facing toward the direction of movement thereof. When there is a strong demand for reducing the thickness of the inkjet printer, such as a case of downsizing the printer as a mobile printer, it is preferable to provide the tubes so as to project from the end surface of the head facing toward the direction of movement thereof.

JP-A-2003-175588 discloses such a type of the inkjet printer. This inkjet printer is provided with two each of tubes for supplying the ink to the recording head from the both end surfaces of the recording head facing the directions of movement so as to project in the direction inclined from the direction of movement of the recording head.

SUMMARY OF THE INVENTION

However, since the tube band is necessary in the structure of JP-A-2003-175588, there are problems such that the number of parts increases whereby a cost reduction is difficult, and an operation to bundle the plurality of tubes (ink supply tubes) is necessary whereby assemble ability is not high.

According to the structure disclosed in JP-A-2002-321351, since the ink supply tubes are integrated into a four-tube plate, it is not necessary to provide a part for bundling the tubes, and hence assemble ability is better. However, flexibility of modification of design is insufficient in a case in which combination of a plurality of tubes having different inner diameter or outer diameter, or combination of a plurality of tubes formed of different materials is required. There is also a problem that a manufacturing cost of the ink supply tube cannot be reduced due to integration into the four-tube plate.

When the tubes are provided so as to project from the end surface of the recording head facing in the direction of movement as disclosed in JP-A-2003-175588, the tubes are sagged above the platen within a range of movement of the recording head when the recording head moves.

Therefore, when the recording medium is jammed at the platen when the recording medium is transported and hence an attempt is made to remove the jammed recording medium, the sagged tubes become obstacle and hence a jammed paper removal cannot be performed easily.

In the inkjet printer having a structure in which a pair of transporting rollers are provided on an upstream side of the recording head with respect to the direction of transportation of the recording medium and a pair of discharging rollers are disposed on a downstream side of the recording head with respect to the direction of transportation of the recording medium, there is a stronger demand for reduction in thickness.

The present invention provides an image recording apparatus in which assemble ability is improved and manufacturing costs are reduced without necessity of a part for bundling midsections of a plurality of ink supply tubes, while using the plurality of single ink supply tubes.

The present invention also provides an image recording apparatus in which even when a recording medium is jammed below a recording head, the jammed recording medium can easily be removed.

According to one aspect of the present invention, there is provided an image recording apparatus including: a recording apparatus body; a carriage being capable of reciprocating in a predetermined direction in the recording apparatus body; a recording head mounted on the carriage and being capable of recording an image on a recording medium by selectively ejecting ink drops thereon; joint portions disposed on the carriage and having paths leading to the recording head; an ink storage disposed in the recording apparatus body separately from the recording head; a plurality of flexible ink supply tubes connected between the ink storage and the joint portions for supplying ink from the ink storage to the recording head; and an intermediate fixing portion provided in the recording apparatus body and fixing the plurality of ink supply tubes, wherein the plurality of ink supply tubes between the intermediate fixing portion and the joint portions are disposed independently and bent at midsections thereof, and a direction of arrangement of the plurality of ink supply tubes at the midsections thereof extending toward the intermediate fixing portion and a direction of arrangement of the plurality of ink supply tubes at the midsections thereof extending toward the joint portions are differentiated.

According to the invention, the range from the midsections (intermediate fixing portion) to the joint portions with respect to the carriage of all the ink supply tubes are portions subjected to no bundling and no restriction. Therefore, by bending (inverting) this portion in such a manner that the direction extending toward the intermediate fixing portion is 180° different from the direction extending toward the joint portions with respect to the carriage and twisting the same so as to differentiate the direction of arrangement of the ink supply tubes extending toward the intermediate fixing portion and the direction of arrangement of the ink supply tubes extending toward the joint portions with respect to the carriage in phase in the bent midsection, the respective ink supply tubes are bent independently, but all the ink supply tubes can easily be settled together.

Therefore, the possibility of disorder (disarrangement) of the arrangement of the ink supply tubes during movement in the longitudinal direction of the bent midsection is reduced, and hence the posture of the ink supply tubes during movement is stabilized. Consequently, the spatial height of the range (movable range) where the ink supply tubes pass through when the carriage is reciprocated can be reduced, and the height of the recording apparatus body can be reduced correspondingly. Furthermore, even when all the ink supply tubes are independent from each other, since the posture during movement is stabilized, it is not necessary to provide an additional tube bundling device, whereby assemble ability is improved and cost reduction is advantageously achieved.

According to another aspect of the invention, there is provided an image recording apparatus including: a carriage being capable of reciprocating in a predetermined direction; a recording head mounted on the carriage and being capable of recording an image on a recording medium by selectively ejecting ink drops thereon; an ink storage disposed separately from the recording head; a conveying unit capable of conveying the recording medium through a recording area in a conveying direction crossing the predetermined direction; a joint portion having a path leading the recording head, and disposed on the carriage in a downstream from the recording head in the conveying direction; and a flexible ink supply tube connected between the ink storage and the joint portion for supplying ink from the ink storage to the recording head, the tube connected to a side surface of the joint portion which faces the predetermined direction.

According to the invention, since the tube is connected to the side surface of the recording head facing the direction of movement thereof, which is on the downstream side of the recording head in the direction of transportation of the recording medium, the tube is prevented from being located within the range of movement of the recording head when the recording head is reciprocating. Therefore, when the recording medium is jammed below the recording head when the recording medium is transported, and hence the jammed recording medium is removed, the tube is not located at the position which impairs removing operation, and hence the removal process of the jammed recording medium can be performed easily. Consequently, the inkjet printer which is superior in usability can be provided.

BRIEF DESCRIPTION OF THE DRAWINGS

The present invention may be more readily described with reference to the accompanying drawings.

DETAILED DESCRIPTION OF THE PREFERRED EMBODIMENTS

Subsequently, embodiments of the present invention will be described.

This embodiment shows a case in which the present invention is applied to a multi function device having a printing function, a copying function, a scanning function, a facsimile function, and a telephoning function. In this embodiment, as shown in FIG. 20, an upstream side of a transporting direction of a recording paper as a recording medium is represented as a rear side, a downstream side of the transporting direction of the recording paper is represented as a front side, and a right side and a left side represent the direction when viewed toward an opening for inserting a paper feeding cassette.

Figure 20:
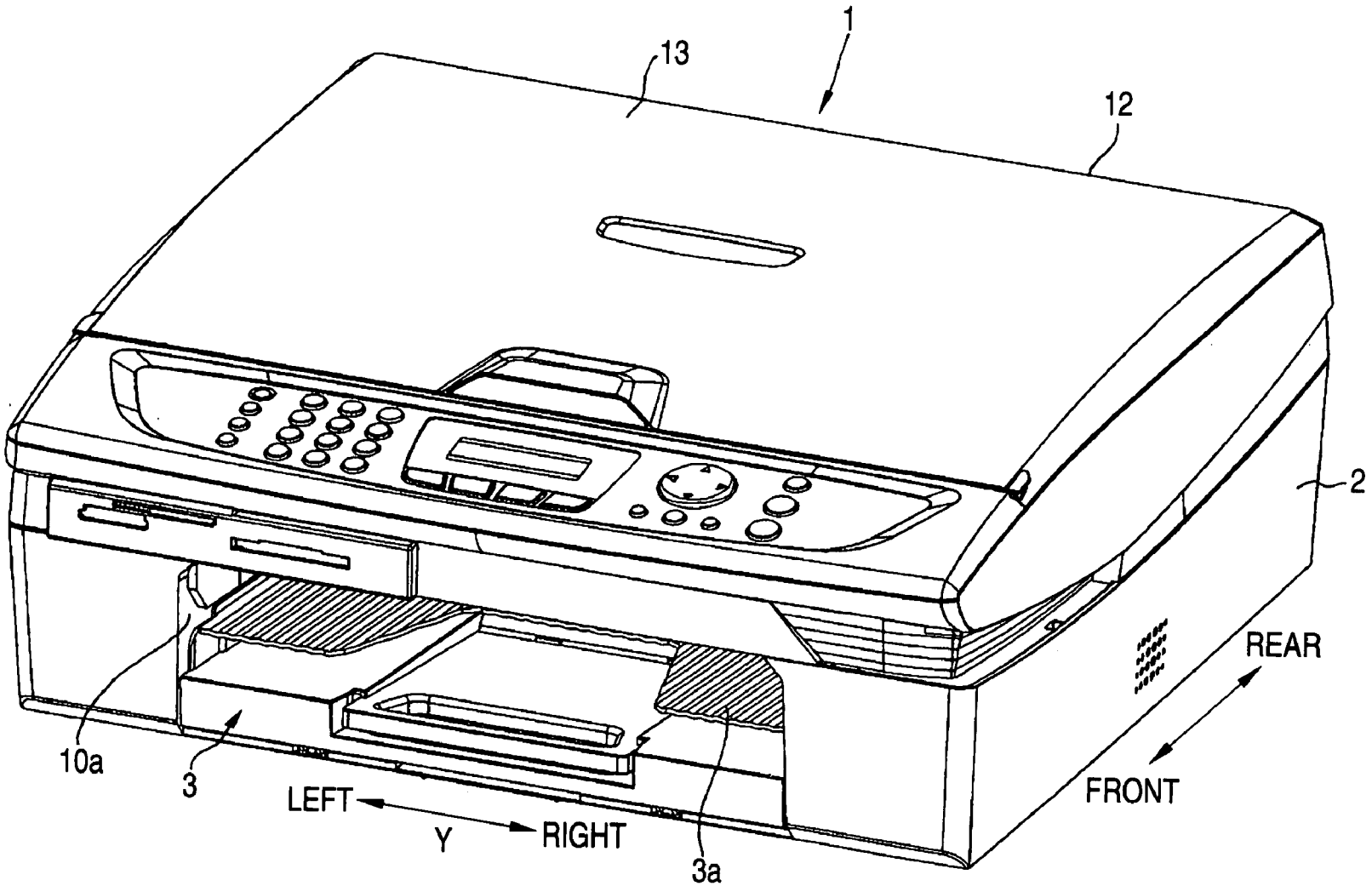
FIG. 20 is a perspective view showing an appearance of a multi function device in which an inkjet printer according to an embodiment of the present invention is mounted.

As shown in FIG. 20, the multi function device or image recording apparatus 1 is provided with an image reading unit 12 used for the copying function (scanning function) and the facsimile function on the upper side, and a recording apparatus body (inkjet printer) 2 for realizing the printing function on the entire portion under the original reading unit 2.

Figure 1:
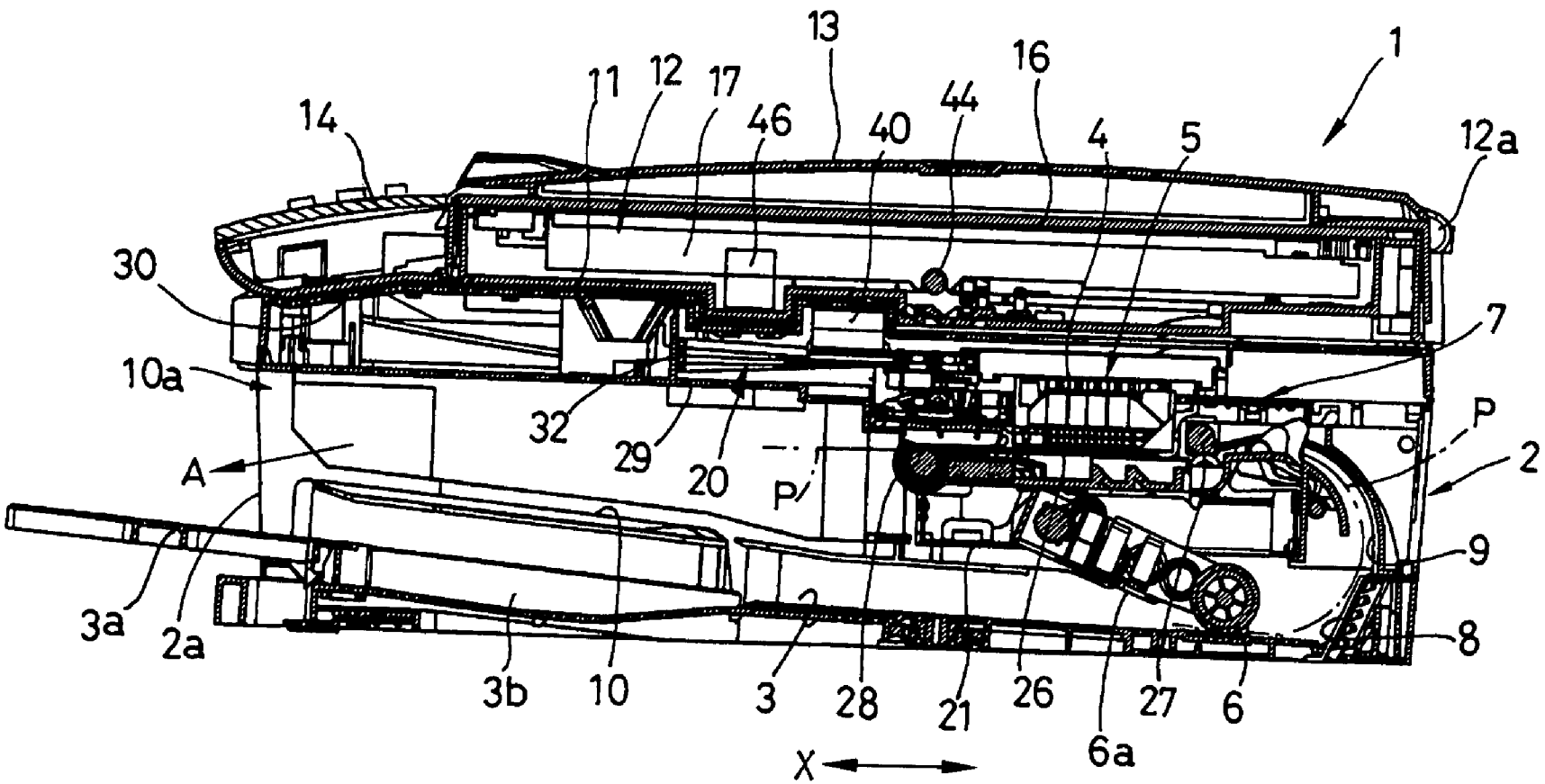
FIG. 1 is a cross-sectional side view of an image recording apparatus according to an embodiment of the present invention.

As shown in FIG. 1, a paper feeding cassette 3 which can be inserted from an opening 2*a* in front (left side in FIG. 1) of the recording apparatus body 2 is disposed at the bottom portion of the recording apparatus body 2 of the apparatus formed of synthetic resin.

In this embodiment, the paper feeding cassette 3 has a form which can accommodate a plurality of pieces of paper P cut into, for example, A4 size, letter size, legal size, postcard size and so on as recording media in stack (accumulated) in such a direction that the shorter side extends in a direction orthogonal to a paper transporting direction (sub scanning direction or X-axis direction). That is, the shorter side extends in a direction orthogonal to the surface of the sheet of FIG. 1 or a main scanning direction (Y-axis direction) in FIG. 1. An auxiliary supporting member 3*a* capable of supporting the rear end of the elongated paper P, such as the legal size, is mounted at the front end of the paper feeding cassette 3 so as to be capable of moving in the X-axis direction. Although FIG. 1 shows a state in which the auxiliary supporting member 3*a* is disposed at a position projecting outward from the recording apparatus body 2, when the paper P which can be completely accommodated within the paper feeding cassette 3 such as A4 size (not projecting outward of the recording apparatus body 2 from the opening 2*a*) is used, the auxiliary supporting member 3*a* can be stored within a storage 3*b* so as not to impair paper feeding.

Arranged on the inner side of the paper feeding cassette 3 (right side in FIG. 1) is a bank 8 for separating the paper in pieces. An arm 6*a* having the upper end portion rotatable in the vertical direction is attached to the recording apparatus body 2 side, and the paper P which is the recording media stacked (accumulated) on the paper feeding cassette 3 is transported one by one by a paper feeding roller 6 provided at the lower end of the arm 6*a* and the bank 8. The separated paper P is fed to a recording unit 7 which is provided upward (at a high level) behind the paper feeding cassette 3 via a U-turn path (feeding path) 9 which is directed upward and sideward. The recording unit 7 includes a reciprocating carriage 5 provided with an inkjet recording head 4 for implementing the printer function, as described later.

A paper discharging unit 10 for discharging paper P recorded by the recording unit 7 with the face up is formed on the upper side of the paper feeding cassette 3, and the paper discharging port 10*a* in communication with the paper discharging unit 10 is opened toward the front side of the recording apparatus body 2.

The image reading unit 12 is disposed on the upper portion of the recording apparatus body 2 for original reading in the copying function or the facsimile function. A bottom wall 11 of the image reading unit 12 is adapted to be superimposed on an upper cover body 30, described later, substantially without gap from above. The image reading unit 12 is adapted to be rotatably opened and closed in the vertical direction with respect to one side end (the side end on the near side in Y-axis direction in FIG. 2) of the recording apparatus body 2 via a hinged portion, not shown, and the rear end of an original cover body 13 for covering the upper surface of the image reading unit 12 is mounted to the rear end of the image reading unit 12 so as to be capable of rotating in the vertical direction about a pivot 12*a*.

An operating panel unit 14 provided with various operating buttons and a liquid crystal display unit is provided in front of the image reading unit 12 on the upper side of the recording apparatus body 2, and the recording unit 7, the paper discharging unit 10, and an ink storage 15 provided on one side of the paper discharging unit 10 are arranged so as to be positioned within a projected area of the image reading unit 12 and the operating panel unit 14 in plan view. In a state in which the auxiliary supporting member 3*a* is stored in the storage 3*b*, the length of the paper feeding cassette 3 in the X-axis direction and the length of the image reading unit 12 and the operating panel unit 14 in the X-axis direction are substantially the same. Therefore, since the image recording apparatus 1 is a substantially rectangular solid of substantially square in plan view, it can be packaged easily for shipping as a product, and the packaging box may be downsized.

A glass plate 16 for placing an original after opening the original cover body 13 upward is provided on the upper surface of the image reading unit 12, and an image scanner unit (CIS: Contact Image Sensor) 17 for reading the original is provided downward thereof so as to be capable of reciprocating in the direction orthogonal to the surface of the sheet of FIG. 1 (Y-axis direction in FIG. 2 to FIG. 6).

Figure 2:
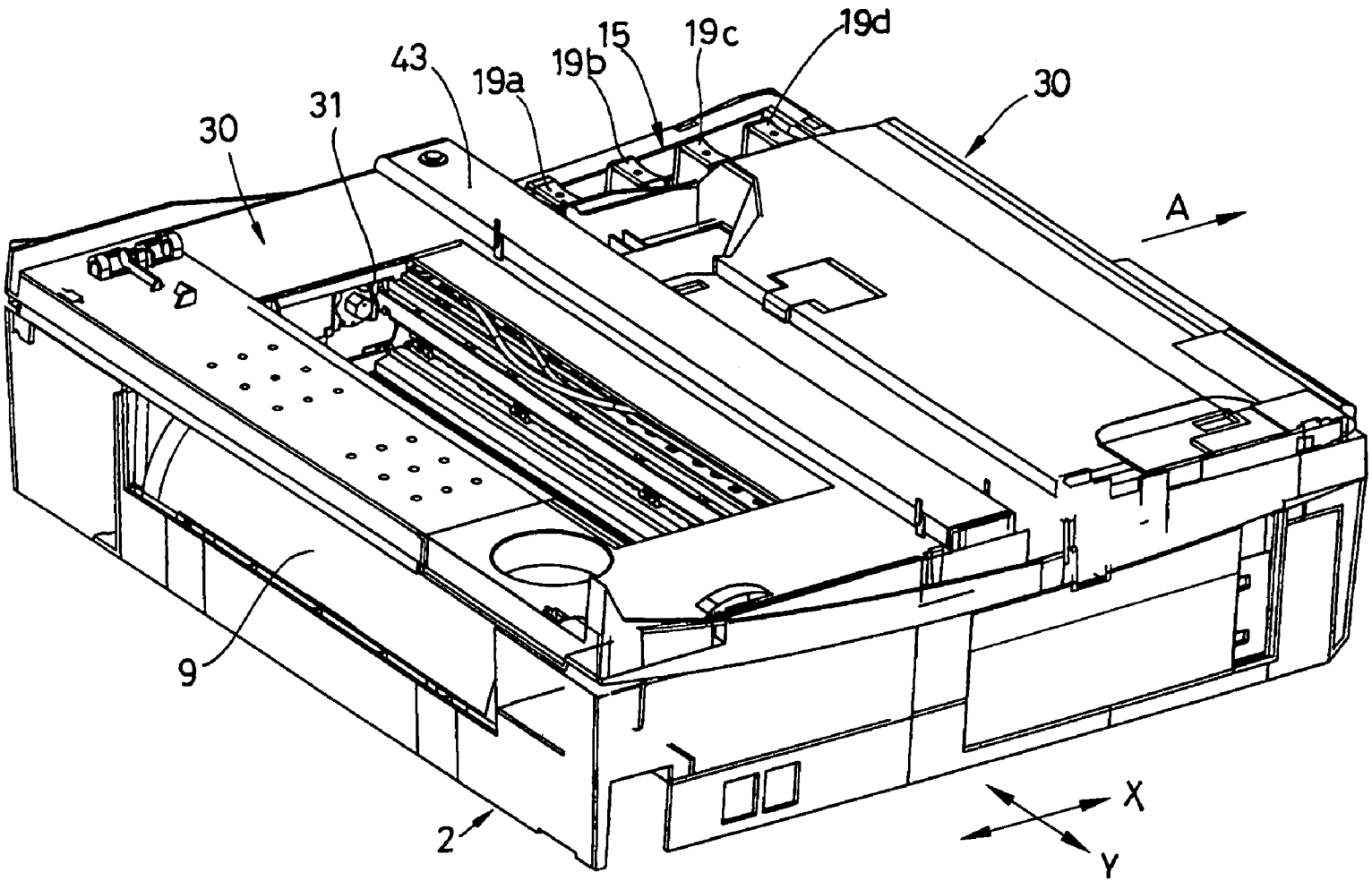
FIG. 2 is a perspective view of an image recording apparatus body.
Figure 3:
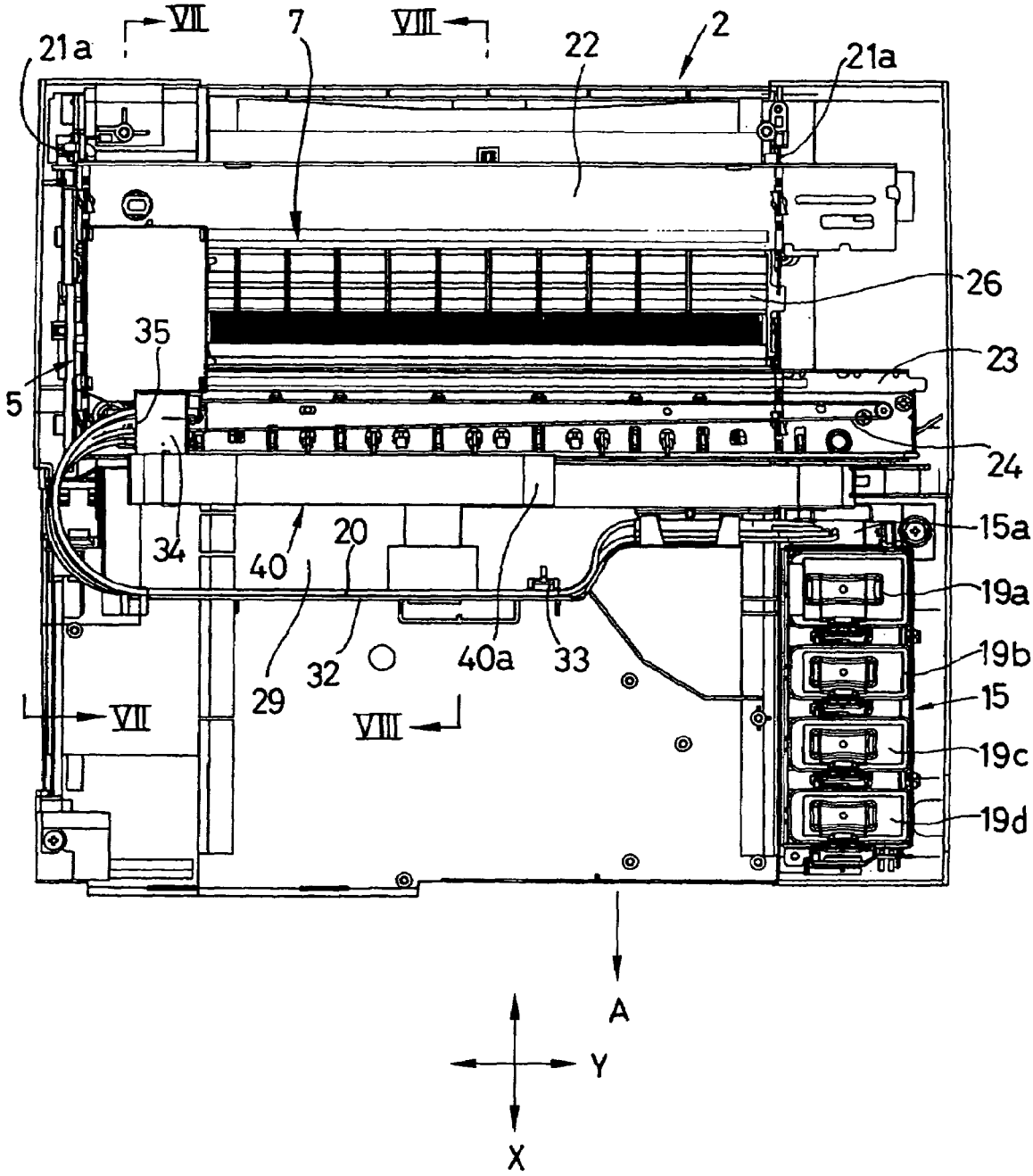
FIG. 3 is a plan view of the image recording apparatus body in a state in which an upper cover body is removed.
Figure 4:
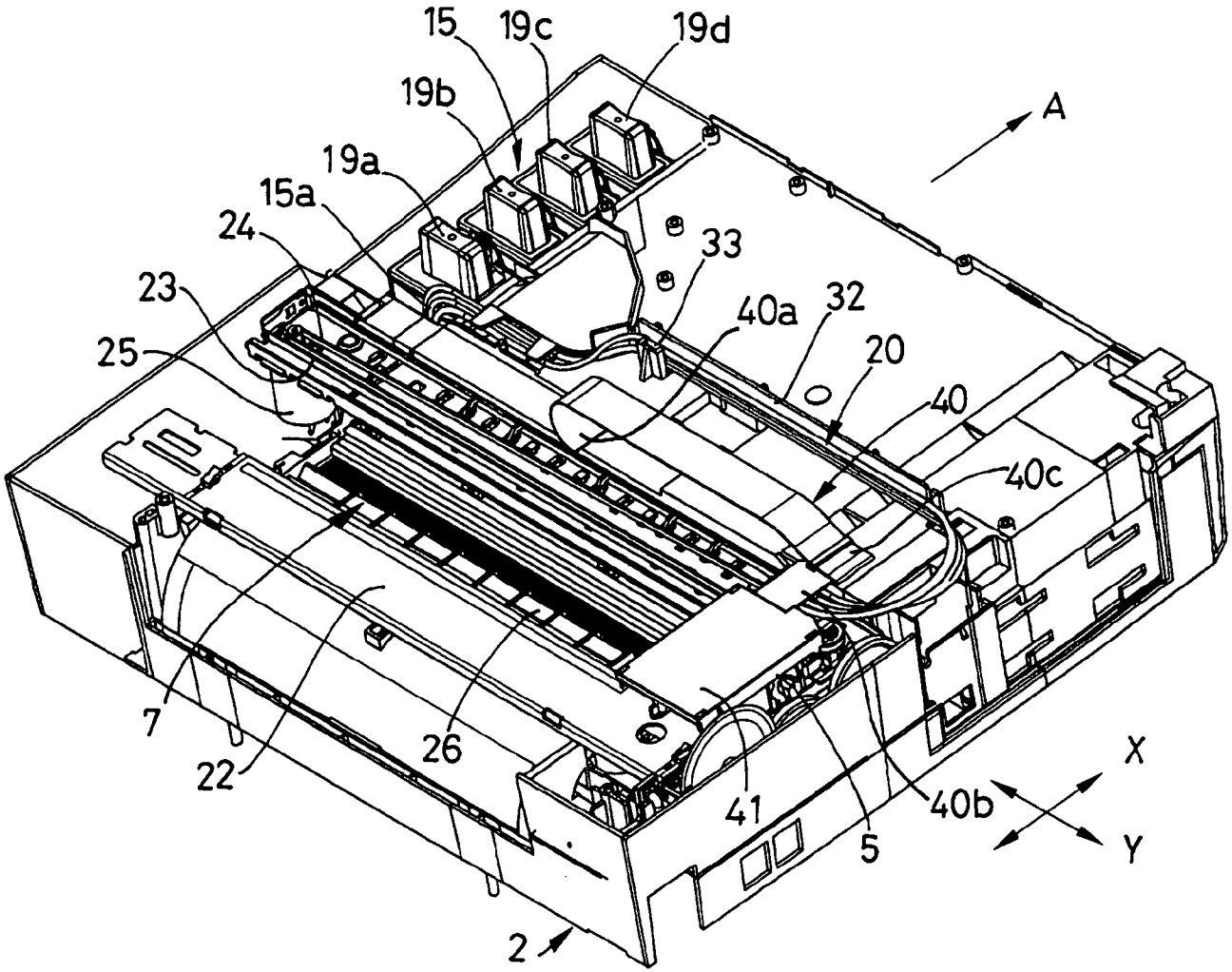
FIG. 4 is a perspective view of the image recording apparatus body in a state in which the upper cover body is removed.

The ink storage 15 is opened upward of the recording apparatus body 2, and the ink storage 15 is adapted to be capable of accommodating ink cartridges 19 of substantially rectangular box shape having a small area in plan view and a high vertical dimension, which contains ink in four colors for full color recording (respective ink cartridges containing each color of black (BK), cyan (C), magenta (M) and yellow (Y) are represented by reference numeral 19*a*-19*d*, see FIG. 2 to FIG. 4), in line along the X-axis direction, and capable of attaching and detaching the same from above.

It is adapted to supply ink from the respective ink cartridges 19 (individual ink cartridge is represented by the reference numerals 19*a*-19*d*) to an inkjet recording head 4, described later, via a plurality of (four, in this embodiment) ink supply tubes (ink tubes) 20 (individual ink supply tube is represented by the reference numerals 20*a*-20*d*). When more than four colors of ink are used (6 to 8 colors, for example), it must simply be adapted to store the ink cartridges as many as the number of colors in the ink storage 15, and must simply increase the number of ink supply tubes 20 corresponding to the number of the ink cartridges.

The recording unit 7 is supported by a pair of left and right side plates 21*a* in a main frame 21 as shown in FIG. 3 to FIG. 6, and includes laterally elongated plate-shaped guide rails 22 and 23 extending in the Y-axis direction (main scanning direction), the carriage 5 slidably mounted so as to straddle the both guide rails 22, 23 and adapted to be capable of reciprocal movement, a timing belt 24 arranged on and in parallel with the upper surface of the guide rail 23 disposed on the downstream side of the paper transporting direction (the direction indicated by an arrow A) for reciprocating the carriage 5 on which the recording head 4 is mounted, a CR (carriage) motor 25 (although it is a DC motor in this embodiment, it may be other types of motor such as a stepping motor) for driving the timing belt 24, and a plate-shaped platen 26 for supporting the paper P transported on the side of the lower surface of the recording head 4. A pair of registration rollers 27 (see FIG. 1) are disposed on the upstream side of transportation with the intermediary of the platen 26, and transport the paper P to the lower surface of the recording head 4. A spur (not shown) which comes into contact with the upper surface of the paper P and a paper discharging roller 28 on the lower surface side are disposed on the downstream side of the platen 26, so that the recorded paper P is transported to the paper discharging unit 10.

An ink receiving unit (not shown) is provided on one side (the position close to the left side plate 21*a* in FIG. 3 in this embodiment) outside the width of the transported paper P (the width in the direction intersecting the paper P transporting direction), and a maintenance unit (not shown) is disposed on the other side (the position close to the right side plate 21*a* in FIG. 3). Accordingly, the recording head 4 inject ink regularly during recording operation at a flashing position provided at the ink receiving unit for preventing clogging of a nozzle, and the ink is received by the ink receiving unit. The maintenance unit corresponds to a waiting position of the carriage 5, where cleaning of a nozzle surface of the recording head 4, selective suction of ink for each color, or recovering process for purging air bubbles in a buffer tank, not shown, of the recording head 4 are performed.

A partitioning plate (lower cover body) 29 is disposed so as to cover the upper side of the discharging unit 10 from the lower surface of the guide rail 23 on the downstream side in the paper transporting direction to the paper discharging port 10*a* at the front end of the recording apparatus body 2. Furthermore, an upper cover body 30 for covering the upper portion of the carriage 5 and its reciprocating path is provided at an appropriate space interposed in-between above the partitioning plate (lower cover body) 29. A rectangular shaped window hole 31 for allowing the reciprocating route of the carriage 5 to be viewed from above is formed at the midsection of the upper cover body 30 (see FIG. 2). When the paper P is jammed in the recording unit 7, a user rotates the image reading unit 12 from the recording apparatus body 2, so that the jammed paper P can be taken out from this window hole 31. In this case, since the ink supply tubes 20 are not routed on the platen 26, the paper P can be removed easily.

Subsequently, the arrangement structure of the flexible ink supply tubes 20 which always connect the respective ink cartridges 19 stored in the ink storage 15 and the recording head 4 of the recording unit 7 will be described in detail.

In this embodiment, the respective ink supply tubes 20*a*-20*d* are tube members independent from each other, and the length of the ink supply tubes 20*a*-20*d* are all the same when in use.

Figure 10:
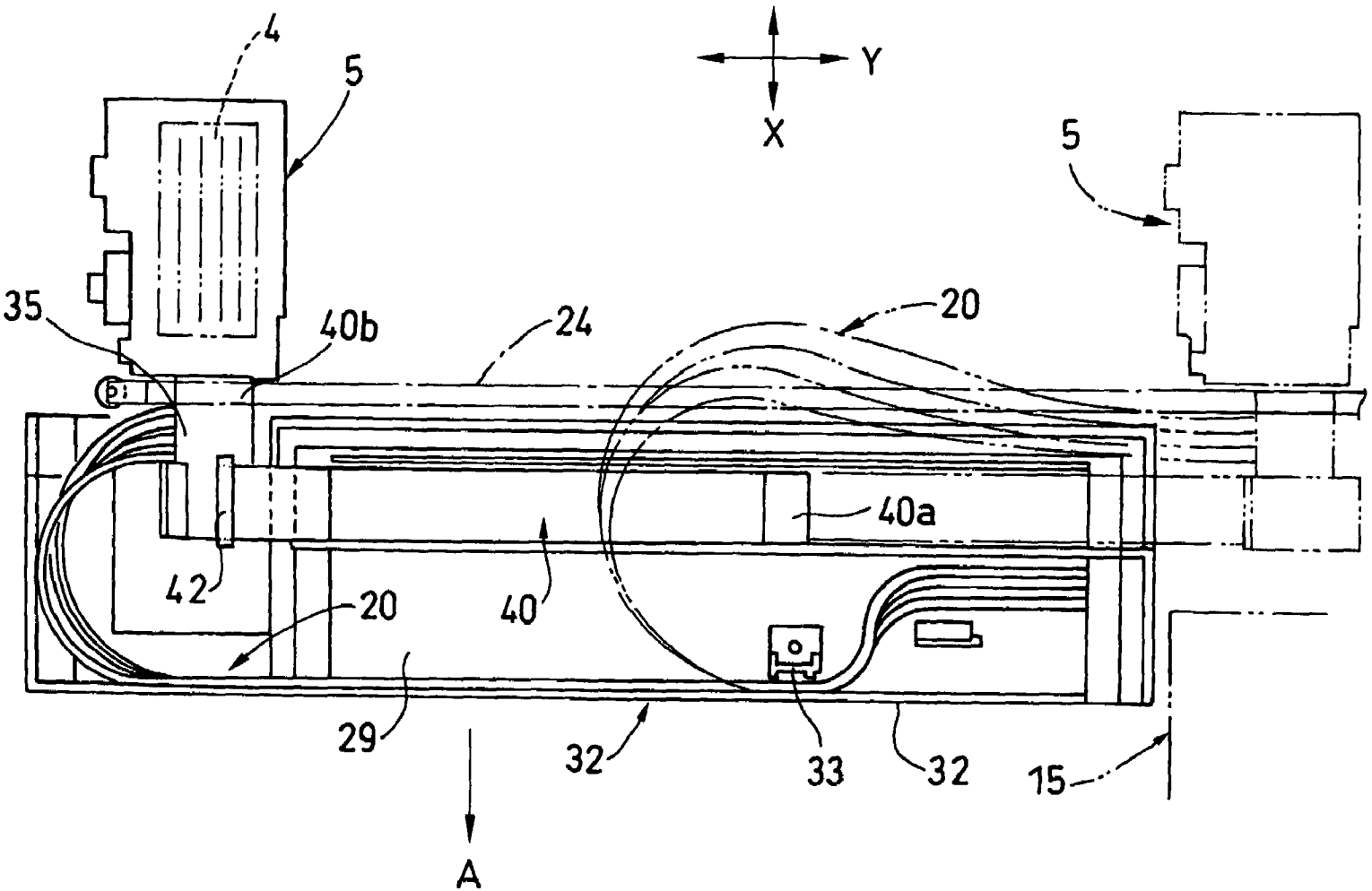
FIG. 10 is a plan view of the arrangement state of the ink supply tubes and the flexible flat cable with respect to the carriage.

As shown in FIG. 3 and FIG. 10, the root portions of the plurality of (four in the embodiment) ink supply tubes 20 are bundled at one end portion 15*a* of the ink storage 15 and extend on the upper surface of the lower cover body 29 from one ends (right ends in FIG. 3 and FIG. 10) toward the other ends (left ends in FIG. 3 and FIG. 10) along the Y-axis direction. In this case, the root portions of all the ink supply tubes 20*a*-20*d* are aligned in a lateral row along the upper surface of the substantially horizontal lower cover body 29. At least part (midsection, for example) of the ink supply tubes 20 are supported on the upper surface of the lower cover body 29.

The whole lengths of the ink supply tubes 20*a*-20*d* are all the same. In other words, the lengths thereof from the one end portion 15*a* of the ink storage 15 to the joint portions (connecting portions) 35 with respect to the carriage 5 are all the same. The one end portion 15*a* is provided with four joint shafts with respect to the four ink supply tubes 20*a*-20*d* so as to project upward, and these joint shafts are juxtaposed along the direction of movement of the carriage 5. Therefore, the lengths of the ink supply tubes 20*a*-20*d* are adjusted by being twisted in from the vertical direction to the lateral direction in the routing path of the ink supply tubes 20*a*-20*d* from an intermediate fixing portion (fixing member 33), described later, to the one end portion 15*a*. Also, since a LAN cable or a USB cable, not shown, run above the routing path of the ink supply tubes 20*a*-20*d* from the intermediate fixing portion (fixing member 33) to the one end portion 15*a*, the ink supply tubes 20*a*-20*d* are twisted from the vertical direction to the lateral direction in the routing path of the ink supply tubes 20*a*-20*d* from the intermediate fixing portion (fixing member 33) to the one end portion 15*a* in terms of reducing the height.

All the ink supply tubes 20*a*-20*d* are twisted so that the midsections thereof extend along one of the vertical surfaces of a laterally elongated vertical partitioning plate 32 of the lower cover body 29 (surface which is substantially vertical), the midsections of all the ink supply tubes 20*a*-20*d* are arranged and fixed (embraced or clamped) in row in the vertical direction between the one vertical surface of the vertical partitioning plate 32 and the fixing member 33 in the form of a vertical plate of synthetic resin fixed by a screw or the like so as to oppose thereto. The portion which fixes (embraces) all the ink supply tubes 20*a*-20*d* between the fixing member 33 and the one vertical surface of the vertical partitioning plate 32 functions as the intermediate fixing portion.

Figure 5:
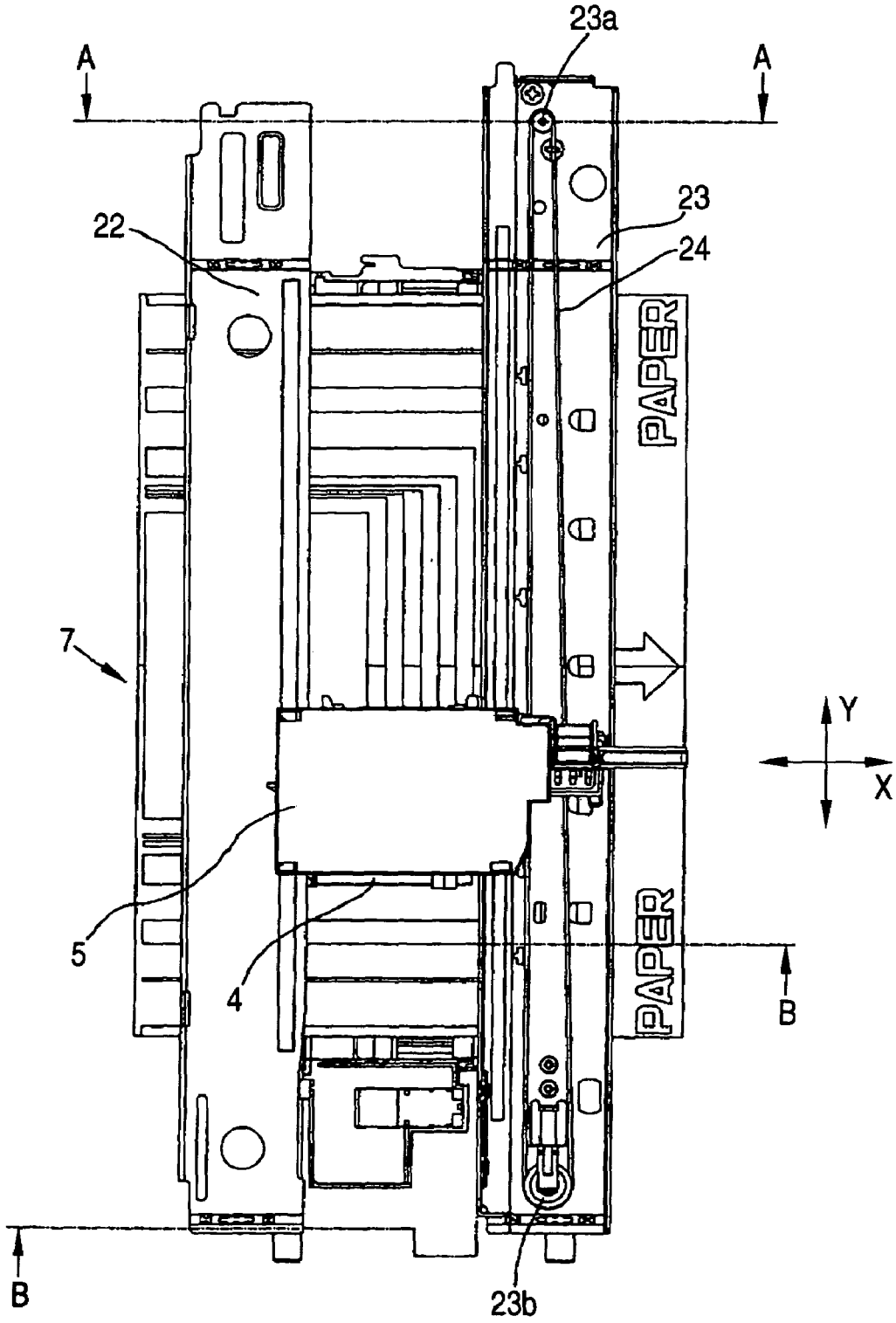
FIG. 5 is a plan view of a carriage and a pair of guide rails.

The position of the intermediate fixing portion (fixing member 33) in the main scanning direction (Y-axis direction, the direction of movement of the carriage 5) is a position where the joint portions (connecting portions) 35 of the ink supply tubes 20*a*-20*d* on the carriage 5 are maintained to have a minimum bending radius with respect to the ink supply tubes 20*a*-20*d* when the carriage 5 is moved to one end portion (for example, the leftmost position from the intermediate fixing portion in FIG. 5 and FIG. 10) in the main scanning direction. The position of the intermediate fixing portion (fixing member 33) in the sub scanning direction (X-axis direction, the direction of movement of the paper P as the recording medium) is a position where the ink supply tubes 20*a*-20*d* on the carriage 5 are maintained to have the minimum bending radius with respect to the joint portion (connecting portion) 35 of the ink supply tubes 20*a*-20*d* even when the carriage 5 is moved to the other end (for example, the rightmost position from the intermediate fixing portion in FIG. 5 and FIG. 10) in the sub scanning direction. In this structure, a predetermined twisted bent portion can be formed in the unrestrained range from the midsections (intermediate fixing portion (fixing member 33)) of all the ink supply tubes 20*a*-20*d* to the joint portions (connecting portions) 35 of the ink supply tubes 20*a*-20*d* on the carriage during the movement of the carriage 5.

Figure 9:
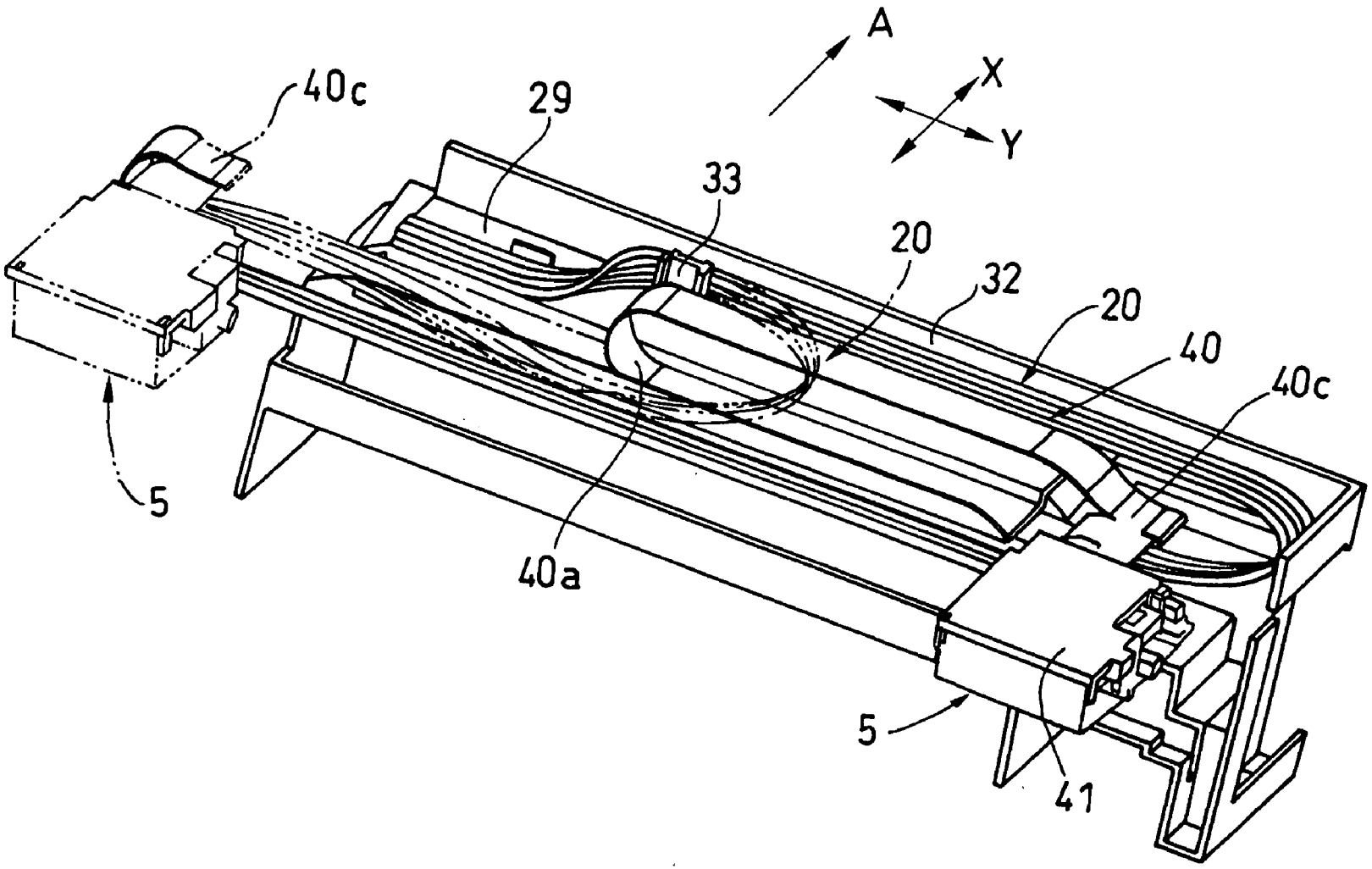
FIG. 9 is a perspective view of a state of arrangement of ink supply tubes and a flexible flat cable with respect to the carriage.

The intermediate fixing portion may have a structure to align the midsections of all the ink supply tubes 20*a*-20*d* in a vertical row and fix (embrace or clamp) the same by a fixing member (not shown), for example, of a downwardly opened U-shape or an upwardly opened U-shape. In FIG. 4 and FIG. 9, it looks to have a laterally opposite relation since the downstream direction of the paper transportation (the direction indicated by an arrow A) is opposite from the appearance in FIG. 3 and FIG. 10.

The carriage 5 is provided with a connecting strip 34 extending substantially horizontally in the down stream direction of the paper transportation (the direction indicated by the arrow A), and the distal ends of all the ink supply tubes 20*a*-20*d* are connected to the joint portions (connecting portions) 35 provided on the left end of the connecting strip 34 in FIG. 3 and FIG. 10 substantially horizontally in a lateral row. Then, the orientation of the midsections of all the ink supply tubes 20*a*-20*d* is inverted from the leftward direction which is substantially parallel to the direction of movement of the carriage 5 to the opposite direction, that is, the rightward direction, and is twisted so that the phase of the row (arrangement) of all the ink supply tubes 20*a*-20*d* is differentiated from the substantially vertical direction on the intermediate fixing portion (fixing member 33) side to the substantially horizontal direction on the joint portion (connecting portion) 35 side between the position of the intermediate fixing portion (fixing member 33) and the joint portion (connecting portion 35. In other words, the midsections of the four ink supply tubes 20*a*-20*d* are bent between the route of the carriage 5 and the intermediate fixing portion (fixing member 33) so as to change the orientation by about 180° in plan view. Then, the ink supply tubes 20*a*-20*d* are routed in such a manner that the direction of arrangement of the portions of the four ink supply tubes 20*a*-20*d* extending from the bent midsection toward the intermediate fixing portion is differentiated in phase from the direction of arrangement of the four ink supply tubes 20*a*-20*d* extending toward the joint portion 35 of the ink supply tubes 20*a*-20*d* on the carriage 5.

Therefore, the ink supply tubes 20*a*-20*d* are extended from the intermediate fixing portion (fixing member 33) in one direction parallel with the direction of movement of the carriage 5, and are extended through the bent midsection in the substantially opposite direction from the one direction, thereby being connected to the joint portions (connecting portions) 35 provided on the connecting strip 34 of the carriage 5. In this arrangement, the predetermined twisted bent portion can be formed on the unrestrained midsections (unrestrained portion from the intermediate fixing portion (fixing member 33) to the connecting strip 34 of the ink supply tubes 20*a*-20*d* with respect to the carriage) of all the ink supply tubes 20*a*-20*d*.

The portions of all the ink supply tubes 20*a*-20*d* are independently separated from each other between the position of the intermediate fixing portion (fixing member 33) and the joint portions (connecting portions) 35.

In this manner, when all the ink supply tubes 20*a*-20*d* are bent (inverted) at the midsections (the unbundled or unrestrained range from the position of the intermediate fixing portion (fixing member 33) to the joint portions (connecting portions) 35) so that the direction extending toward the intermediate fixing portion (fixing member 33) is differentiated from the direction extending toward the joint portion 35 with respect to the carriage 5 by about 180°, and are twisted so that the direction of arrangement of the ink supply tubes 20*a*-20*d* extending toward the intermediate fixing portion (fixing member 33) and the direction of arrangement of the ink supply tubes 20*a*-20*d* extending toward the joint portions 35 with respect to the carriage 5 of the bent midsection are differentiated in phase, the respective ink supply tubes 20*a*-20*d* can easily be settled together although all the ink supply tubes 20*a*-20*d* are independently bent. In particular, when the arrangement of the ink supply tubes 20*a*-20*d* on the side of the intermediate fixing portion (fixing member 33) is vertical direction, and the arrangement on the side of the joint portions 35 is horizontal direction, the possibility of disorder (disarrangement) of the arrangement of the ink supply tubes 20*a*-20*d* during movement in the longitudinal direction of the bent midsection is reduced, and hence the posture of the ink supply tubes 20*a*-20*d* during movement is stabilized.

Consequently, the spatial height of the range (movable range, the unbundled or unrestrained range) where the ink supply tubes 20*a*-20*d* pass when the carriage 5 reciprocates in the Y-axis direction (main scanning direction) can be reduced, whereby the height of the recording apparatus body 2 can be reduced. On the other hand, when the arrangement of the ink supply tubes 20*a*-20*d* on the side of the joint portions 35 is horizontal, interference with other parts which are disposed in high density on the side of the carriage 5 is reduced, and hence the height of the carriage 5 portion can be reduced. By arranging the ink supply tubes 20 in the vertical direction in the intermediate fixing portion (fixing member 33), the dimension in the direction of depth (X-axis direction) of the recording apparatus body 2 can be reduced into a compact size and the lengths of all the ink supply tubes 20 can be substantially equalized. Furthermore, even when all the ink supply tubes 20*a*-20*d* are independent from each other, the postures during movement is stabilized, and hence it is not necessary to provide an additional tube bundling device, whereby assemble ability is improved and cost reduction is advantageously achieved. The angle of difference in phase is preferably from about 30° to about 120°.

Therefore, the phrase "between the route of the carriage 5 and the intermediate fixing portion" means a range where the ink supply tubes 20*a*-20*d* pass when the carriage 5 reciprocates in the Y-axis direction (the main scanning direction), and also the unbundled or unrestrained range of the ink supply tubes 20*a*-20*d*, and the portion whereof the posture is not restrained (fixed) by being connected at the ends of the ink supply tubes 20*a*-20*d* to the joint portions 35 on the carriage 5. In other words, it means the portion which is not fixed to the part which reciprocates integrally with the carriage 5, and is not fixed to the intermediate fixing portion. Therefore, as the carriage 5 reciprocates in the Y-axis direction (main scanning direction), the position of the bent midsections of the ink supply tubes 20*a*-20*d* changes in the direction of the length of the ink supply tubes 20*a*-20*d* from the joint portions 35.

Describing this embodiment further in detail, the ink supply tube 20*a* for supplying black (BK) ink is 1.6 mm in inner diameter and 2.4 mm in outer diameter. The three of the ink supply tube 20*b* for supplying cyan (C) ink, the ink supply tube 20*c* for supplying magenta (M) ink, and the ink supply tube 20*d* for supplying yellow (Y) ink are 1.2 mm in inner diameter and 2.0 mm in outer diameter. Therefore, the bending rigidity of the ink supply tube 20*a* with respect to the axis (cross-sectional secondary moment) is 1.91 times the bending rigidity of the ink supply tubes 20*b*-20*d* for color ink such as cyan. In the embodiment, the reason for employing a larger inner diameter for the ink supply tube 20*a* for black (BK) ink than for ink of other colors is to increase the amount of ink supply per unit time since the number of nozzles for black (BK) ink on the recording head 4 is set to a value larger (actually, two times the nozzle row) than that for ink of other colors in order to increase the recording speed for monochrome recording in comparison with the case of color recording.

Then, the ink supply tube 20*a* for black (BK) ink is disposed at the position of one end portion 15*a* of the ink storage 15 on the upstream most of the paper transporting direction, then the ink supply tube 20*b* for cyan (C) ink is disposed on the downstream side thereof, and subsequently, the ink supply tube 20*c* for magenta (M) ink is disposed on the downstream side thereof followed by the ink supply tube 20*d* for the yellow (Y) ink. Then, in the embodiment shown in FIG. 11, FIG. 13 and FIG. 15, the ink supply tubes 20*a*, 20*b*, 20*c*, 20*d* are arranged at the intermediate fixing portion (fixing member 33) in this order vertically from the top. In contrast, in the embodiment shown in FIG. 12 and FIG. 14, the ink supply tubes 20*a*, 20*b*, 20*c*, and 20*d* are arranged at the intermediate fixing portion (fixing member 33) in this order vertically from the bottom. Therefore, in either cases, the radius of curvature R of the ink supply tube 20*a* for black (BK) ink is the largest, and the curvature radius decreases in the order from the ink supply tube 20*b* for cyan (C) ink, the ink supply tube 20*c* for magenta (M) ink, and the ink supply tube 20*d* for yellow (Y) ink at the bent midsection.

In this manner, by increasing the curvature radium R of the ink supplying tube 20*a* for black (BK) ink having a larger bending rigidity than the other ink supply tubes 20*b*-20*d* having smaller bending rigidity, the load exerted on the ink supply tube 20*a* for black (BK) ink having high bending rigidity due to bending deformation can be alleviated, whereby durability of all the ink supply tubes can be substantially equalized.

Figure 13:
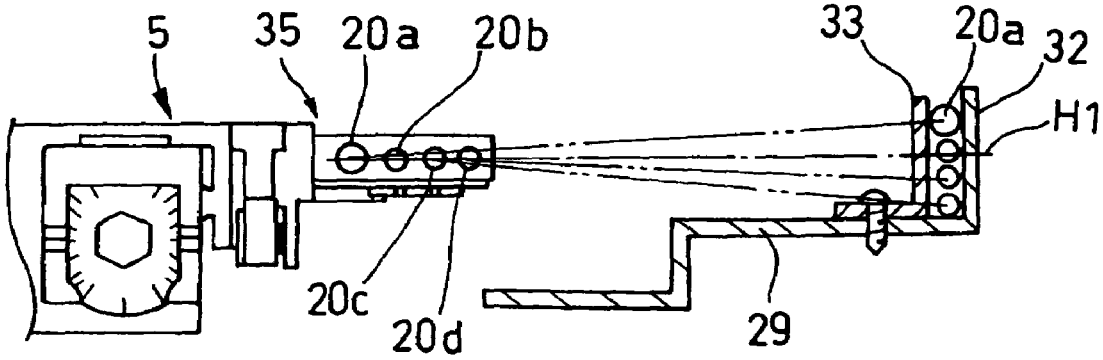
FIG. 13 is an explanatory drawing showing an arrangement phase of the ink supply tubes according to a first embodiment.

Then, as shown in FIG. 13, at the intermediate fixing portion via the fixing member 33, when arranging in such a manner that the level of the ink supply tube 20*a* for black (BK) ink having the highest bending rigidity out of the four ink supply tubes 20 arranged substantially in the vertical direction is shifted upward than a horizontal level H1 (the level of the joint portions 35 with respect to the carriage) passing through (connecting) the centerlines of all the ink supply tubes 20*a*-20*d* at the position of the joint portions 35, and the ink supply tube 20*b* for cyan (C) ink at the lower next position is at substantially the same level as the horizontal level H1, and the level of the two other ink tubes 20*c*, 20*d* having the low bending rigidity is shifted downward with respect to the horizontal level H1 (joint portions 35), the downward action force generated when the ink supply tube 20*a* having high bending rigidity is routed downward toward the joint portion 35 and the upward action force generated when the two ink supply tubes 20*c*, 20*d* having low bending rigidity are routed upward toward the joint portion 35 are balanced, whereby the carriage 5 can be slid with respect to the guide rails 22, 23 lightly without exerting excessive force.

Figure 14:
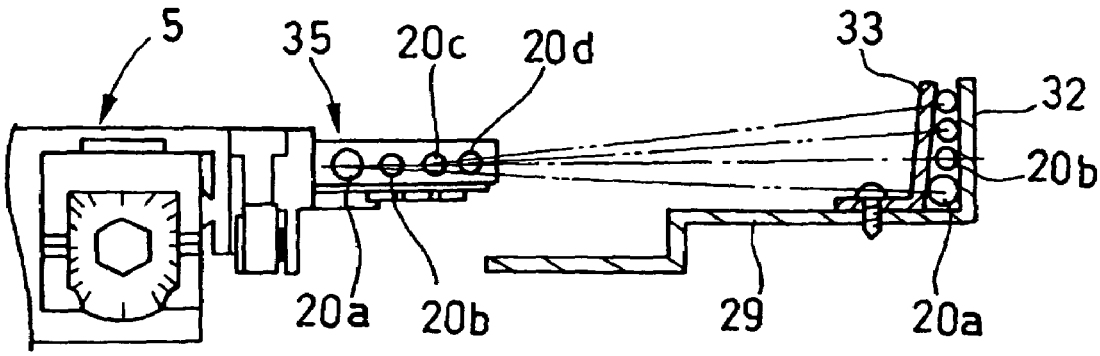
FIG. 14 is an explanatory drawing of another embodiment showing the arrangement phase of the ink supply tubes.

In the same manner, as shown in FIG. 14, at the intermediate fixing portion via the fixing member 33, when arranging in such a manner that the arranged level of the ink supply tube 20*a* for black (BK) ink having the highest bending rigidity is shifted downward with respect to the horizontal level H1 (the level of the joint portions 35 with respect to the carriage) passing through (connecting) the centerlines of all the ink supply tubes 20*a*-20*d* at the position of the joint portions 35, the ink supply tube 20*b* for cyan (C) ink at the upper next position thereof is arranged at substantially the same level as the horizontal level H1, and the level of the other two ink supply tubes 20*c*, 20*d* having lower bending rigidity is shifted upward in comparison with the horizontal level H1 (joint portions 35), the upward action force generated when the ink supply tube 20*a* having the high bending rigidity is routed upward toward the joint portions 35 and the downward action force generated when the two ink supply tubes 20*c*, 20*d* having lower bending rigidity are routed downward toward the joint portions 35 are balanced.

Figure 15:
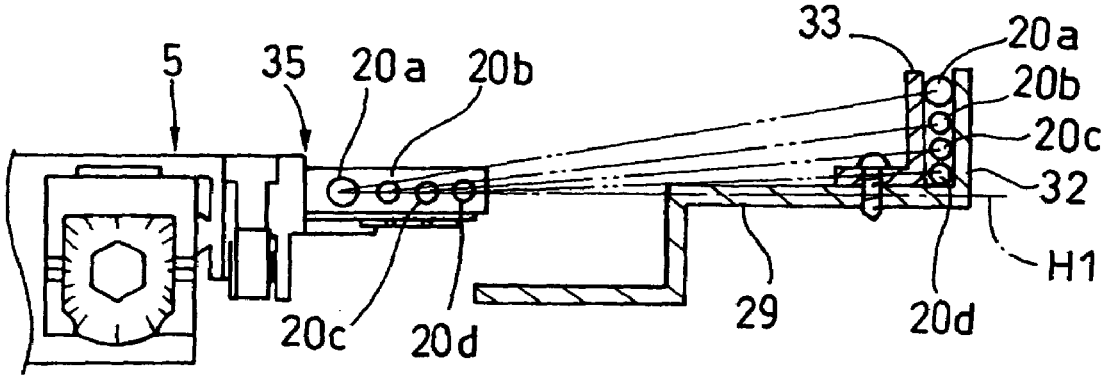
FIG. 15 is explanatory drawings of still another embodiment showing the arrangement phase of the ink supply tubes.

As shown in FIG. 15, at the intermediate fixing portion via the fixing member 33, when the arranged levels of all the ink supply tubes 20*a*-20*d* are set to be higher than the horizontal level H1 passing through (connecting) the centerlines of all the ink supply tubes 20*a*-20*d* at the position of the joint portions 35, the action force generated when these ink supply tubes 20*a*-20*d* are routed downward toward the joint portions 35 works. Then, when the carriage 5 is placed on the guide rails 22, 23 on the upstream side and the downstream side in the direction of paper transportation from above, the carriage 5 is prevented from lifting up from the both guide rails 22, 23 by the downward action force with high reliability, whereby reciprocating movement in the main scanning direction (Y-direction) can be stabilized.

In the above-described respective embodiments, even when the lengths of all the ink supply tubes 20*a*-20*d* are set to the equal length, the ink supply tubes 20*a*-20*d* can be independently bent at the respective bent midsections thereof (movable range, the unbundled and unrestrained range) in association with the movement of the carriage 5 in the horizontal scanning direction (the plurality of ink supply tubes can be relatively displaced), and assemble ability of connection of the ink supply tubes is improved.

Figure 16A:
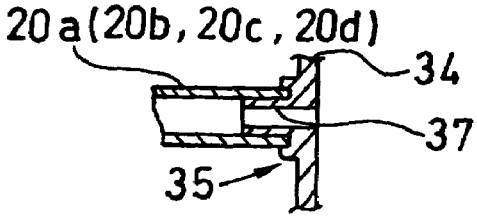
FIG. 16A is an enlarged cross-sectional view of a principal portion of joint portions between ends of the ink supply tubes and the carriage.
Figure 16B:
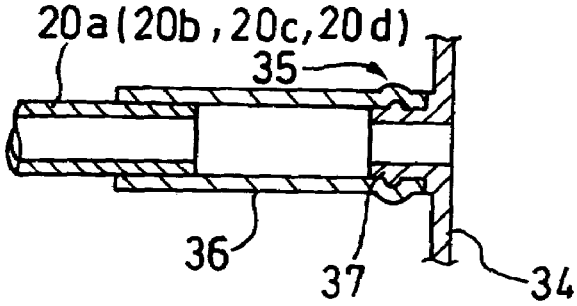
FIG. 16B is an enlarged cross-sectional view of a principal portion of the ends of the ink supply tubes according to another embodiment.
Figure 17:
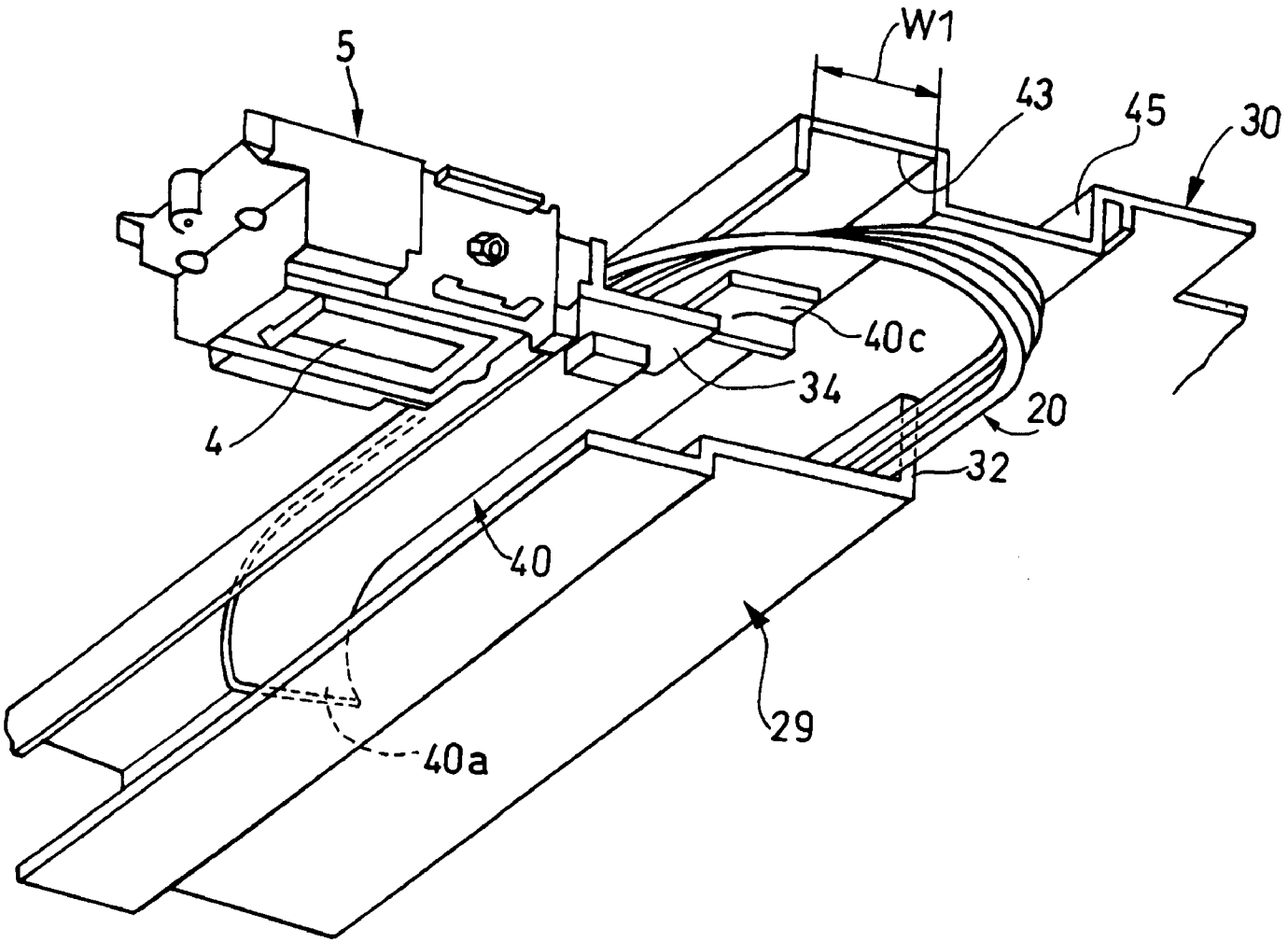
FIG. 17 is a perspective view of a guiding portion of the flexible flat cable viewed from below.

In the respective embodiments, preferably, a resilient communicating member 36 is interposed between the ends of the respective ink supply tubes 20*a*-20*d*, and the respective joint portions 35 with respect to the carriage 5. For example, the joint portions 35 shown in FIG. 16A are configured in such a manner that the ends of the respective ink supply tubes 20*a*-20*d* are inserted and secured on respective cylindrical projections 37 formed integrally on the connecting strip 34 formed of hard synthetic resin. On the other hand, as shown in FIG. 16B, by interposing the flexible resilient communicating member 36 formed of soft synthetic resin or rubber between the respective projections 37 and the respective ink supply tubes 20*a*-20*d*, the torque generated by the bending external force exerted on the midsections of the respective ink supply tubes 20*a*-20*d* when being bent is absorbed by the resilient deformation of the resilient communicating member 36, and hence moment for causing the carriage 5 to rotate is reduced, whereby entanglement of the ink supply tubes with respect to the both guide rails 22, 23 when the carriage moves in the main scanning direction is reduced or eliminated, so that the recording accuracy can be improved. In addition, angular flexibility in leading (connecting) the respective ink supply tubes 20*a*-20*d* in non-parallel with axes of the respective projections 37 is increased, so that assemble ability of the image recording apparatus 1 is improved correspondingly.

In the case where more than four ink supply tubes 20 are used, such as a case in which six to eight colors of ink are used for improving the quality of color recording, or a case in which brightening agent is injected on the paper P in order to achieve the bright finish on the surface of the paper P, it is also possible to separate such the plurality of ink supply tubes 20 into two groups by adequate number of tubes, and arranging the separated respective groups of ink supply tubes 20 so that the bent midsections on the projecting side thereof is oriented toward the reverse direction of the movement of the reciprocating carriage 5. In this arrangement, the height of the space used for passing the ink supply tubes 20 can be reduced by reducing the number of ink supply tubes 20 to be bent in the same direction, and the moment for causing the carriage 5 to rotate can advantageously be diminished since the bending directions are opposite from each other.

Figure 12:
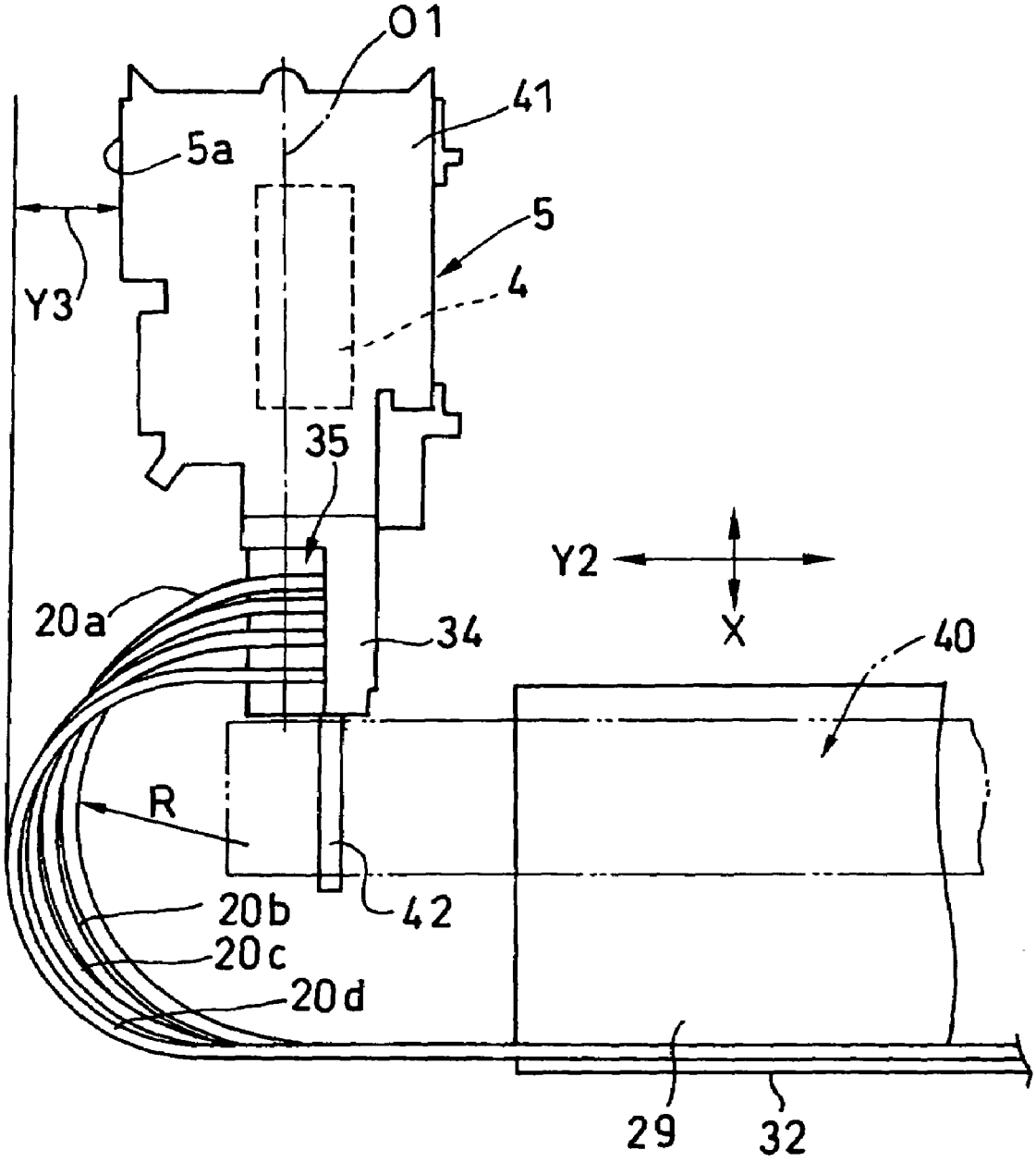
FIG. 12 is an explanatory drawing showing the route of the ink supply tubes in plan view.

As shown in FIG. 12, when the midsections of all the ink supply tubes 20 (the range from the position of the intermediate fixing portion (fixing member 33) to the joint portions (connecting portions) 35, the movable range of the ink supply tubes 20, the unbundled and unrestrained range) are bent (inverted) so that the direction extending toward the intermediate fixing portion (fixing member 33) and the direction extending toward the joint portions 35 with respect to the carriage 5 are differentiated by approximately 180°, and the arranged positions of the joint portions 35 of all the ink supply tubes 20 with respect to the carriage 5 are set to be shifted in the opposite direction from the projecting direction of the bent midsections of the ink supply tubes 20 with respect to a widthwise centerline 01 in the reciprocating direction (Y-axis direction) of the carriage 5, a horizontal distance Y3 (see FIG.

12) from a side surface 5*a* of the carriage 5 to the projecting end of the bent midsections at the end of the movement of the carriage 5 toward the bent midsections (a Y2 direction in FIG. 12) can be reduced. Therefore, the space required in the Y-axis direction for the movement of the ink supply tubes 20 when the carriage 5 is reciprocating in the horizontal scanning direction (Y-axis direction) can be reduced, whereby the width direction of the recording apparatus body 2 can advantageously be downsized.

In this embodiment, a flexible flat cable 40 for transmitting an instruction signal for causing the nozzle of the recording head 4 mounted on the carriage 5 to selectively discharge the ink drops from a control unit, not shown, provided on the side of the recording apparatus body 2 is disposed in the range (movable range, unbundled or unrestrained range) through which the ink supply tubes 20*a*-20*d* pass when the carriage 5 reciprocates in the Y-axis direction (horizontal scanning direction) so as to extend in substantially parallel with the direction of extension of the ink supply tubes 20 (see FIG. 3, FIG. 4, FIG. 9, FIG. 10, FIG. 11 and FIG. 12).

Then, the projecting directions of the bent midsections of the ink supply tubes 20 and the bent midsection of the flexible flat cable 40 are set to be opposite from each other with respect to the reciprocating direction of the carriage 5. In other words, the direction of extension of the ink supply tubes 20 to the joint portion 35 with respect to the carriage 5 and the direction of extension of the flexible flat cable 40 to the carriage 5 are set to be apart from each other. It is also set in such a manner that the midsection of the flexible flat cable 40 is bent so as to be inverted upside down in the space between the upper and lower cover bodies 30, 29.

In this arrangement, the ink supply tubes 20 and the flexible flat cable 40 can be formed in substantially the same level in the vertical direction (in the same horizontal surface), and consequently, the thickness of the entire image recording apparatus 1 can be reduced.

Figure 18:
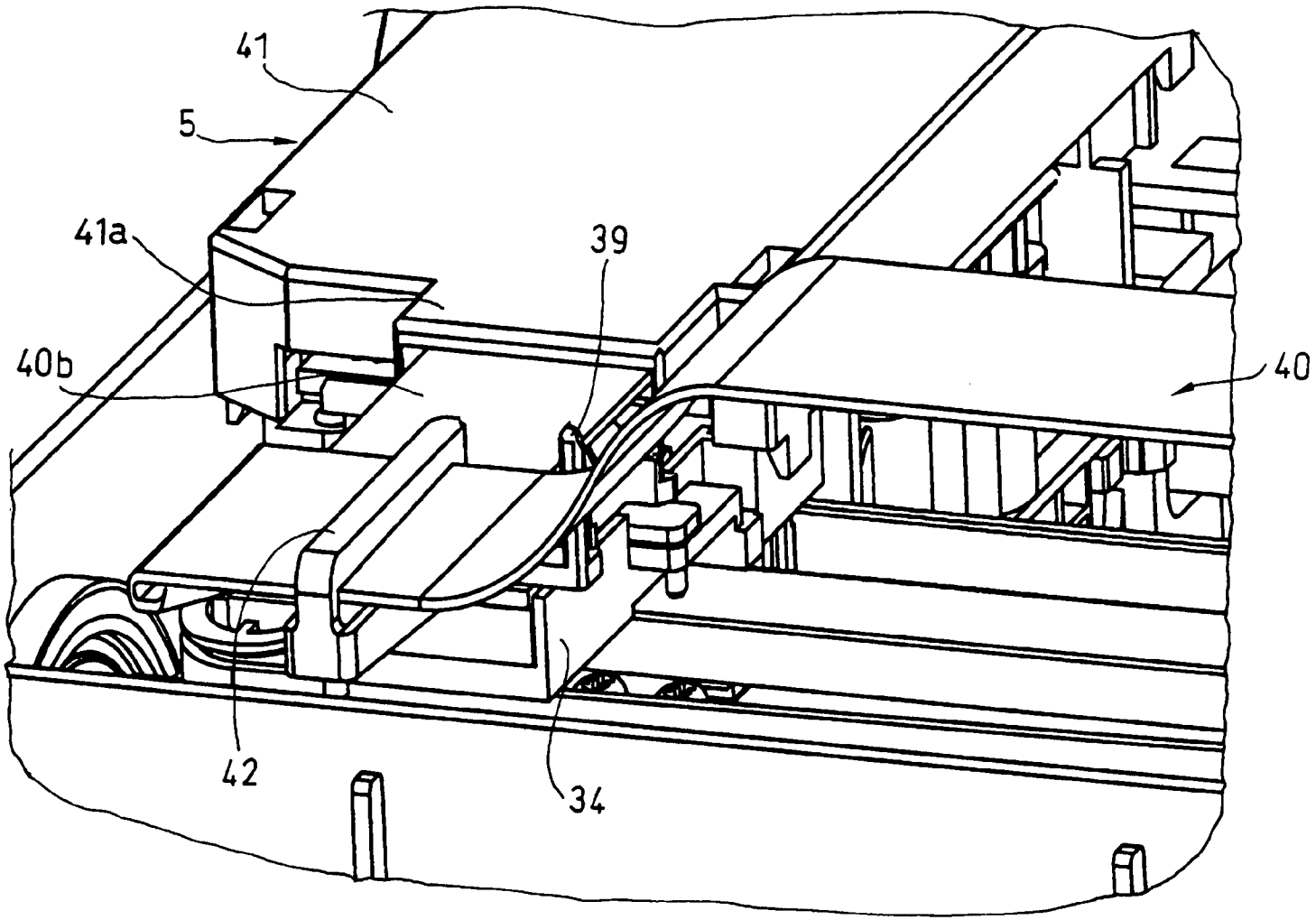
FIG. 18 is a partly enlarged perspective view showing a fixing portion of the flexible flat cable with respect to the carriage.
Figure 19:
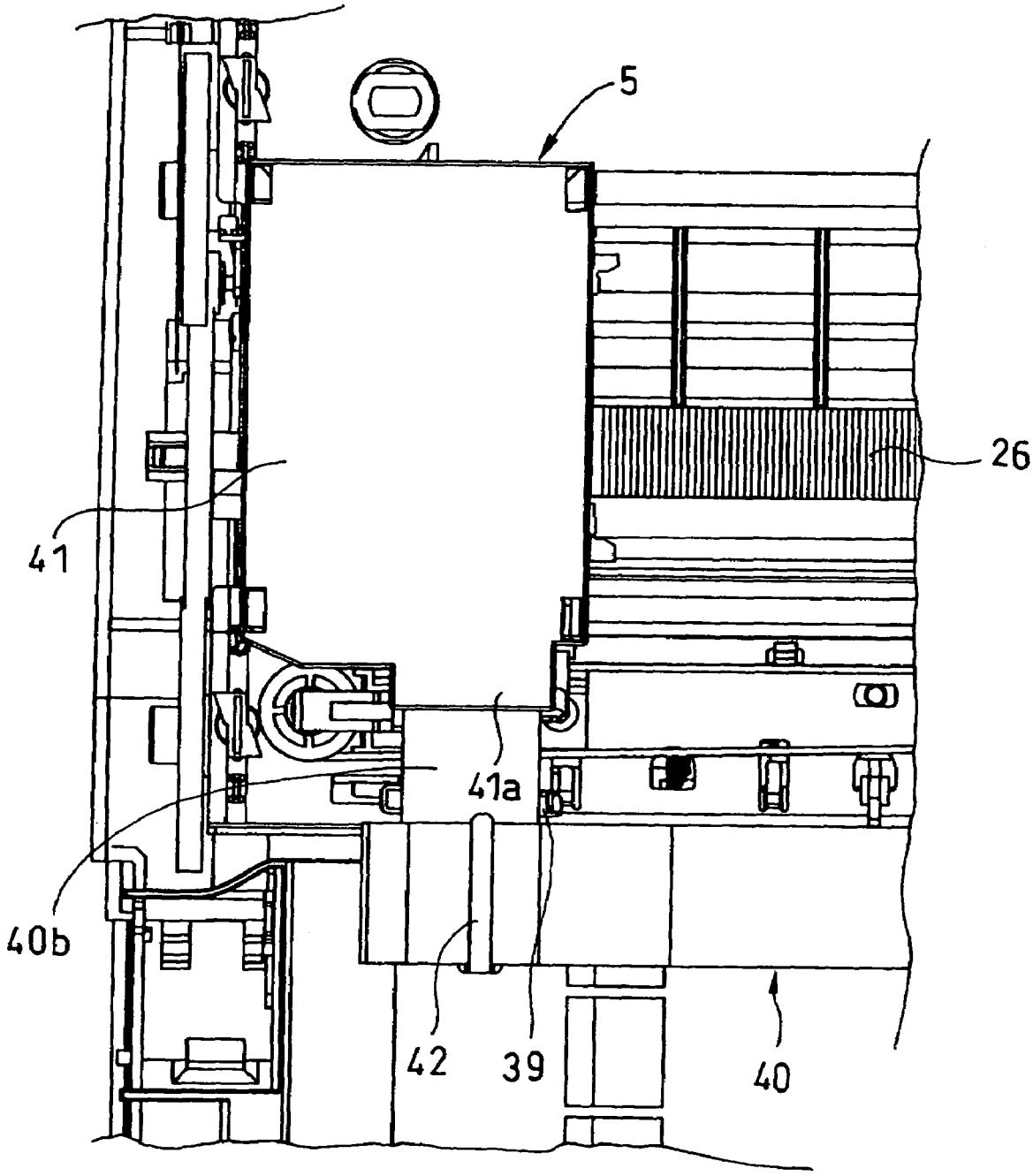
FIG. 19 is a partly enlarged plan view showing the fixing portion of the flexible flat cable with respect to the carriage.

The wide surface of the flexible flat cable 40 is disposed in parallel with the upper surface of the lower cover body 29. The midsection 40*a* of the flexible flat cable 40 is fixed to the lower cover body 29 at the substantially center of the range of movement of the carriage 5 in the Y-axis direction, the proximal portion, not shown, is connected to a main substrate (not shown) of the image recording apparatus 1, while a distal end 40*b* of the flexible flat cable 40 is bent by 90° with respect to the midsection and connected to a control substrate (not shown) of the recording head 4 provided on the lower surface side of a lid cover body (recording head cover) 41 of the carriage 5 in the vicinity (upward) of the joint portions of the ink supply tubes 20 (see FIG. 11). A bent portion 40*c* in the vicinity of the distal portion 40*b* is clamped and fixed by a clip 42 provided at the connecting strip 34 of the carriage 5. Then, as shown in FIG. 18 and FIG. 19, an opening portion 41*a* (inserting side of the flexible flat cable 40) extending in the shape of the apprentice on the upper side of the lid cover body 41 is formed into an inverted angular U-shape in cross section, and the opening width thereof is substantially the same as the width of the flexible flat cable 40. In this arrangement, the mounting posture of the distal end 40*b* of the flexible flat cable 40 can be retained further reliably and the fixing operation of the flexible flat cable 40 can be facilitated, whereby assemble ability of the apparatus is improved.

At least one side, preferably both sides of the connecting strip 34 on which the flexible flat cable 40 is placed, is/are provided with (a) projection(s) 39 for restraining the position of the distal end 40*b* of the flexible flat cable 40 (or preventing the lateral shaking). Accordingly, the flexible flat cable 40 attached to the carriage 5 is prevented from displacing and also the flexible flat cable 40 is prevented from coming off or loosening at the inserted portion even by the reciprocal movement of the carriage 5.

Furthermore, the upper cover body 30 for covering above the space of the movable range of the ink supply tubes 20 and the flexible flat cable 40 is integrally formed with a first guiding groove 43 which is elongated in the Y-axis direction and opening downward. The width W1 of the first guiding groove 43 in the X-axis direction is set to a width slightly wider than a width W2 of the flexible flat cable 40 (see FIG. 7, FIG. 8, FIG. 11, and FIG. 17). Then, the upper half portion of the flexible flat cable 40 is disposed so as to be slidable with the reciprocal movement of the carriage 5 in the Y-axis direction in a state of being fitted into the first guiding groove 43 formed on the upper cove body 30. Therefore, the moving flexible flat cable 40 does not shake in the widthwise direction. Since the portion of the first guiding groove 43 projects upward with respect to the upper surface of the entire upper cover body 30, and other portions are located at the lower levels, the recording apparatus can be downsized without forming a useless space in the direction of the height of the recording apparatus body 2.

Furthermore, a guide shaft 44 of the image scanner unit 17 in the image reading unit 12 is disposed so as to extend in the Y-axis direction adjacently along the outside of a side plate 43*a* (the side of the upward oriented projecting ridge which corresponds to the guiding groove) extending downward of the first guiding groove 43. Then, the upwardly opened second guiding groove 45 is formed on the bottom wall 11 of the image reading unit 12 adjacent to the downwardly opened first guiding groove 43, and a flexible flat cable 46 for transmitting the signal transmission with respect to the image scanner unit 17 is disposed in the second guiding groove 45 along the longitudinal direction thereof (see FIG. 1, FIG. 7, FIG. 8, and FIG. 17). In this arrangement, the movable range of the image scanner unit 17 which moves in the Y-axis direction and the flexible flat cables 40, 46 is completely partitioned by the upper cover body 30, whereby they can be disposed substantially in the same level without mutual interference of the movement. Consequently, the arrangement level of the image reading unit 12 can advantageously be lowered.

As described above, the ink supply tubes 20 extend from the intermediate fixing portion in one direction in parallel with the direction of movement of the carriage, extend through the bent midsection in a direction substantially opposite to the one direction, and is connected to a connecting strip of the carriage 5.

Also, the position of the intermediate fixing portion 33 along the direction of movement of the carriage is a position where the minimum bending radius of the ink supply tubes can be maintained with respect to the joint portions of the ink supply tubes on the carriage when the carriage is moved to one end in this direction of movement, and the position of the intermediate fixing portion along the direction of movement of the recording medium is a position where the minimum bending radius of the ink supply tubes can be maintained with respect to the joint portions of the ink supply tubes on the carriage when the carriage is moved to the other end in the direction of movement thereof as well.

According to the structure, unrestrained midsections of all the ink supply tubes 20 can be formed into predetermined twisted bent portions during movement of the carriage.

Further, the difference of the phase is set to a range between 30° and 120°.

Since the twisting angle to achieve the different phase from the direction of arrangement of the ink supply tubes is between 30° and 120°, stability of the twisted posture of the bent midsection of the ink supply tubes is improved.

Additionally, the plurality of ink supply tubes 20 are arranged substantially along a vertical direction at the intermediate fixing portion, and the plurality of ink supply tubes are arranged substantially in a horizontal direction at the joint portions 35 with respect to the carriage 5.

Since the arrangement of the ink supply tubes 20 is horizontal on the side of the joint portions, interference with other parts which are disposed in high density on the side of the carriage is reduced, and hence the height of the carriage portion can further be reduced. By arranging the ink supply tubes in the horizontal direction on the side of the joint portions 35, although the arrangement of the ink supply tubes is vertical direction in the intermediate fixing portion, the length of the required space for arranging and moving the ink supply tubes along the transporting direction of the recording medium can be reduced, whereby the image recording apparatus can advantageously be downsized.

Further, the plurality of ink supply tubes 20 are arranged in such a manner that one ink supply tube having a largest bending rigidity out of the plurality of ink supply tubes is bent to have a largest radius of curvature at the bent midsection thereof.

Therefore, a load exerted on the ink supply tube having high bending rigidity due to bending deformation can be alleviated, whereby durability of all the ink supply tubes 20 can be substantially equalized. When the ink supply tubes are arranged in the vertical direction at the intermediate fixing portion, the space for arranging the ink supply tubes in the direction of the depth of the image recording apparatus body can be reduced, whereby the image recording apparatus body can advantageously be downsized.

Further, the ink supply tube having the largest bending rigidity is arranged at one of a lowermost position and an uppermost position at the intermediate fixing portion 33.

By disposing the ink supply tube having high bending rigidity at the lowermost position in the vertical direction, a force for retaining the ink supply tubes upward in the vertical direction is generated by its twisting force, and hence a sliding load between the ink supply tubes 20 and the lower cover body can be reduced. On the other hand, by disposing the ink supply tube having high bending rigidity at the uppermost position in the vertical direction, a force for retaining the ink supply tubes downward in the vertical direction is generated by its twisting force, and hence a force for holding down the carriage to which the ink supply tubes are connected downward in the vertical direction is generated, whereby the carriage can advantageously be prevented from lifting upward from a guide rail.

In addition, an arranged level of the ink supply tube having the largest bending rigidity out of the plurality of ink supply tubes arranged substantially in the vertical direction at the intermediate fixing portion 33 is shifted upward or downward with respect to the level of the joint portions with respect to the carriage and arranged levels of the remaining plurality of ink supply tubes are shifted downward or upward from the same level as the joint portions.

A downward (or upward) action force generated when the ink supply tube having high bending rigidity disposed upwardly (or downwardly) of the level of the joint portion 35 thereof is routed toward the joint portion and a total upward (downward) action force generated when the plurality of ink supply tubes having low bending rigidity disposed downwardly (or upwardly) of the level of the joint portions are routed toward the joint portion can easily be balanced, whereby the carriage can advantageously be slid with respect to the guide rail lightly without exerting excessive force to the guide rail.

Also, the arranged levels of all the plurality of ink supply tubes arranged substantially in the vertical direction at the intermediate fixing portion 33 may be shifted upward or downward with respect to the level of the joint portions with respect to the carriage.

Since the downward action force is generated by routing all the ink supply tubes downward from the intermediate fixing portion 33 toward the joint portions, the carriage 5 can advantageously be prevented from lifting from the guide rail with high reliability.

In addition, the number of the ink supply tubes 20 is four and only one of the ink supply tubes is formed to have high bending rigidity.

Only the one ink supply tube for ink with high consumption must simply be increased in bending rigidity, and hence only the state of usage of ink and the thickness of the corresponding ink supply tube must simply be selected.

Additionally, the lengths of all the plurality of the ink supply tubes 20 are set to the same length.

Since the lengths of all the ink supply tubes are the same, assemble ability is advantageously improved in comparison with the case in which the length is changed for each ink color.

Further, resilient communicating members 36 are interposed between ends of the respective ink supply tubes and the corresponding respective joint portions with respect to the carriage.

By interposing the highly flexible resilient communicating members 36 formed of soft synthetic resin or rubber between the joint portions with respect to the carriage and the ink supply tubes, torque generated by a bending external force exerted on the midsections of the respective ink supply tubes when being bent is absorbed by the resilient deformation of the resilient communicating members, and hence moment for causing the carriage to rotate is reduced, whereby entanglement of the ink supply tubes with respect to the guide rail when the carriage 5 moves is reduced or eliminated, so that the recording accuracy can be improved. In addition, angular flexibility in leading (connecting) the respective ink supply tubes in non-parallel with the axes of the joint portions is increased, so that assemble ability of the image recording apparatus 1 is improved correspondingly.

Figure 21:
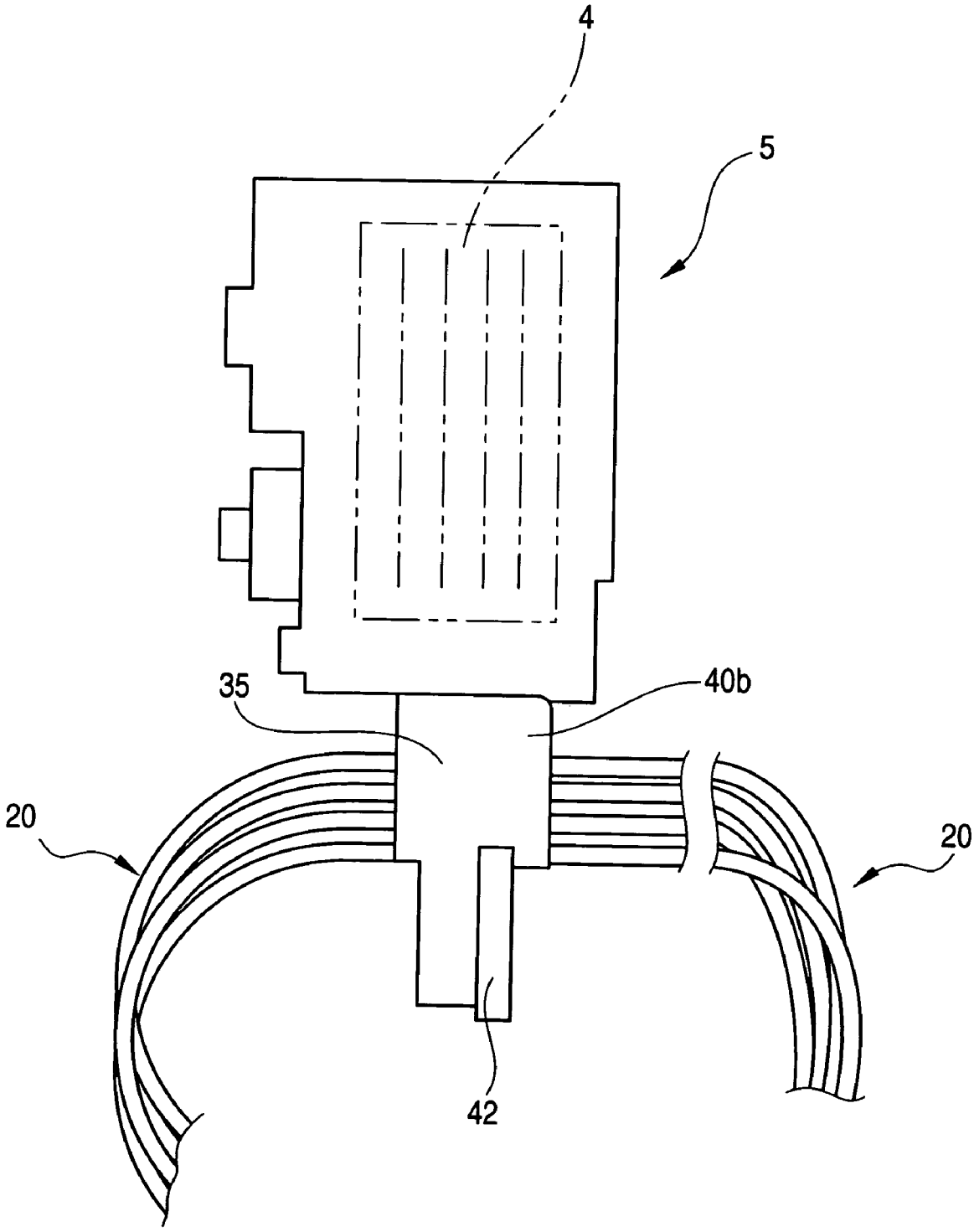
FIG. 21 is a plan view of a modified example.
Figure 22:
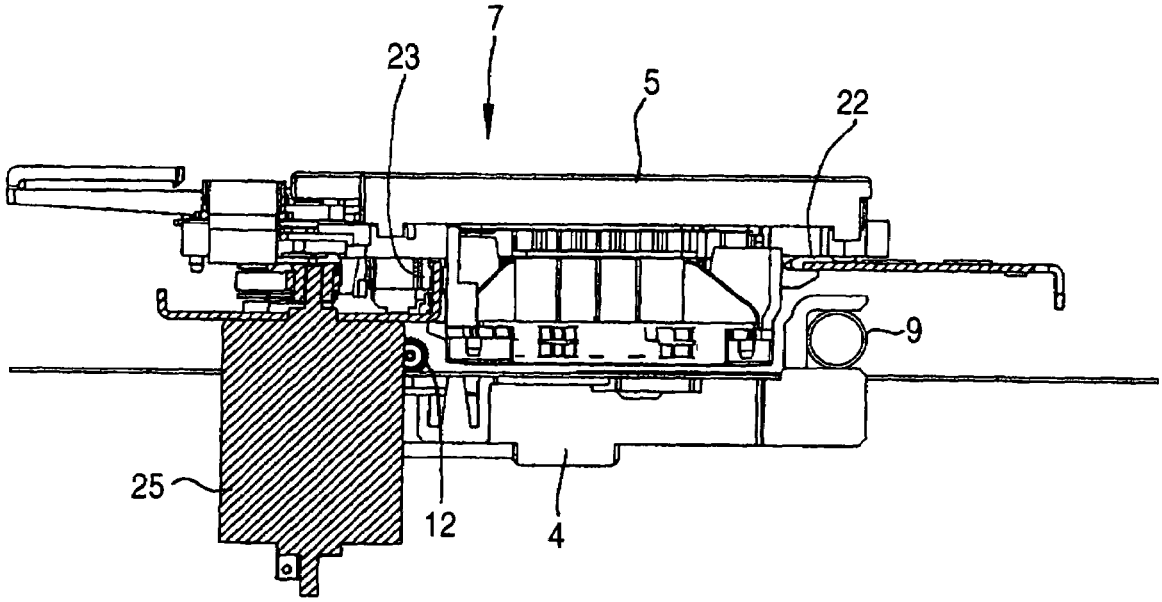
FIG. 22 is a cross-sectional view taken along a line A-A in FIG. 5.
Figure 23:
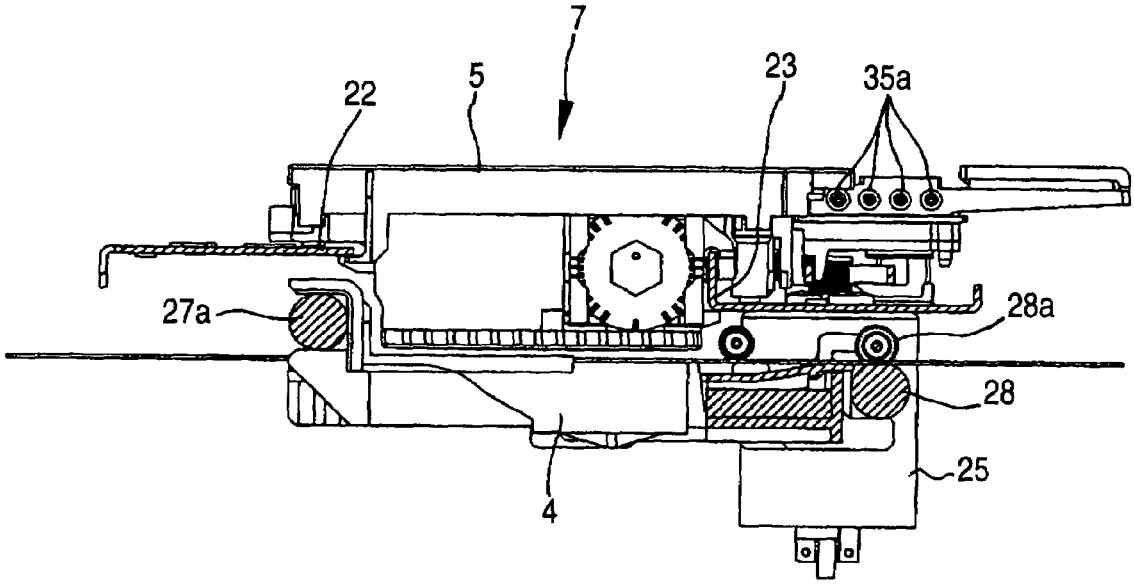
FIG. 23 is a cross-sectional view taken along a line B-B in FIG. 5.

The plurality of ink supply tubes may be separated into two groups by adequate number as shown in FIG. 21, and the ink supply tubes of each separated group are arranged so that projecting sides of the bent midsections are oriented in the direction of the reverse movement of the reciprocating carriage 5.

The height of the space used for passing the ink supply tubes can be reduced by reducing the number of ink supply tubes to be bent in the same direction, and the moment for causing the carriage 5 to rotate can advantageously be diminished since the bending directions are opposite from each other.

Further, the arranged positions of the joint portions 35 of the plurality of ink supply tubes with respect to the carriage are shifted in the opposite direction from the projecting direction of the bent midsections of the ink supply tubes with respect to the widthwise center of the range of the reciprocal movement of the carriage.

The distance from the side surface of the carriage 5 to the projecting end of the bent midsection at the end of movement of the carriage in the direction toward the bent midsections of the ink supply tubes can be reduced. Therefore, the space required for the movement of the ink supply tubes 20 when the carriage reciprocates can be reduced, whereby the width of the recording apparatus body can advantageously be reduced.

Also, a flexible flat cable 40 for transmitting recording signals to the recording head is connected to the recording apparatus body and the carriage without extending along the plurality of ink supply tubes 20.

Since the ink supply tubes and the flexible flat cable 40 are completely separated, flexibility in design of arrangement is improved.

In addition, the flexible flat cable 40 is fixed by a clamping unit and a recording head cover disposed at the joint portions of the ink supply tubes.

Thus, the fixing operation of the flexible flat cable 40 is facilitated and assemble ability of the apparatus is improved.

Moreover, the flexible flat cable 40 is disposed in a movable range of the ink supply tubes in association with the reciprocal movement of the carriage.

Since the ink supply tubes and the flexible flat cable are disposed in the same movable range, the required space can be reduced, whereby the image recording apparatus can advantageously be downsized.

In addition, the recording apparatus body is provided with an upper cover body and a lower cover body for covering above and below a space of the movable range of the ink supply tubes 20, a midsection of the flexible flat cable is bent so as to be inverted in the vertical direction in the space between the upper and lower cover bodies, an upper half of the flexible flat cable is adapted to be slidable along a downwardly opened guiding groove formed on the upper cover body.

Since the flexible flat cable 40 can be moved along the guiding groove on the upper cover body, the flexible flat cable is prevented from being displaced in association with the movement thereof.

Additionally, projecting directions of the bent midsections of the plurality of ink supply tubes 20 and of the bent midsection of the flexible flat cable 40 are set to be opposite direction from each other in the direction of the reciprocal movement of the carriage.

Since the directions of the bent midsections of the ink supply tubes and the flexible flat cable 40 are opposite from each other, interference is advantageously prevented even when the movable range is shared. In addition, the ink supply tubes and the flexible flat cable can be disposed at substantially the same level (in substantially the same horizontal plane), the thickness of the entire image recording apparatus can advantageously be reduced consequently.

Moreover, a guide shaft of an image reading unit is disposed above the upper cover body adjacently along the side of an upward oriented projecting ridge which corresponds to the downwardly opened guiding groove formed on the upper cover body.

Therefore, the movable range of the flexible flat cable 40 connected to a reciprocating image scanner unit and a carriage is completely partitioned by the upper cover body while the arrangement level of the image reading unit is lowered, and hence their movements are not interfered with each other.

In addition, an upwardly opened second guiding groove is formed above the upper cover body so as to extends in parallel with the downwardly opened guiding groove formed on the upper cover body, and the flexible flat cable is disposed along a longitudinal direction of the second guiding groove.

Since the upwardly opened second guiding groove is formed in parallel with the downwardly opened guiding groove formed on the upper cover body, and the flexible flat cable is disposed in the second guiding groove along the longitudinal direction thereof, the vertical space required for the movement of the flexible flat cable can be arranged at a low level, whereby the thickness of the entire image recording apparatus can advantageously be reduced.

Additionally, the upward oriented projecting ridge and the second guiding groove are formed on a bottom wall of the image reading unit.

Since the upward oriented projecting ridge and the second guiding groove are formed on the bottom wall of the image reading unit, the upper cover body and the bottom wall can be superimposed one on another tightly, and the thickness of the entire image recording apparatus can further be reduced.

Figure 8:
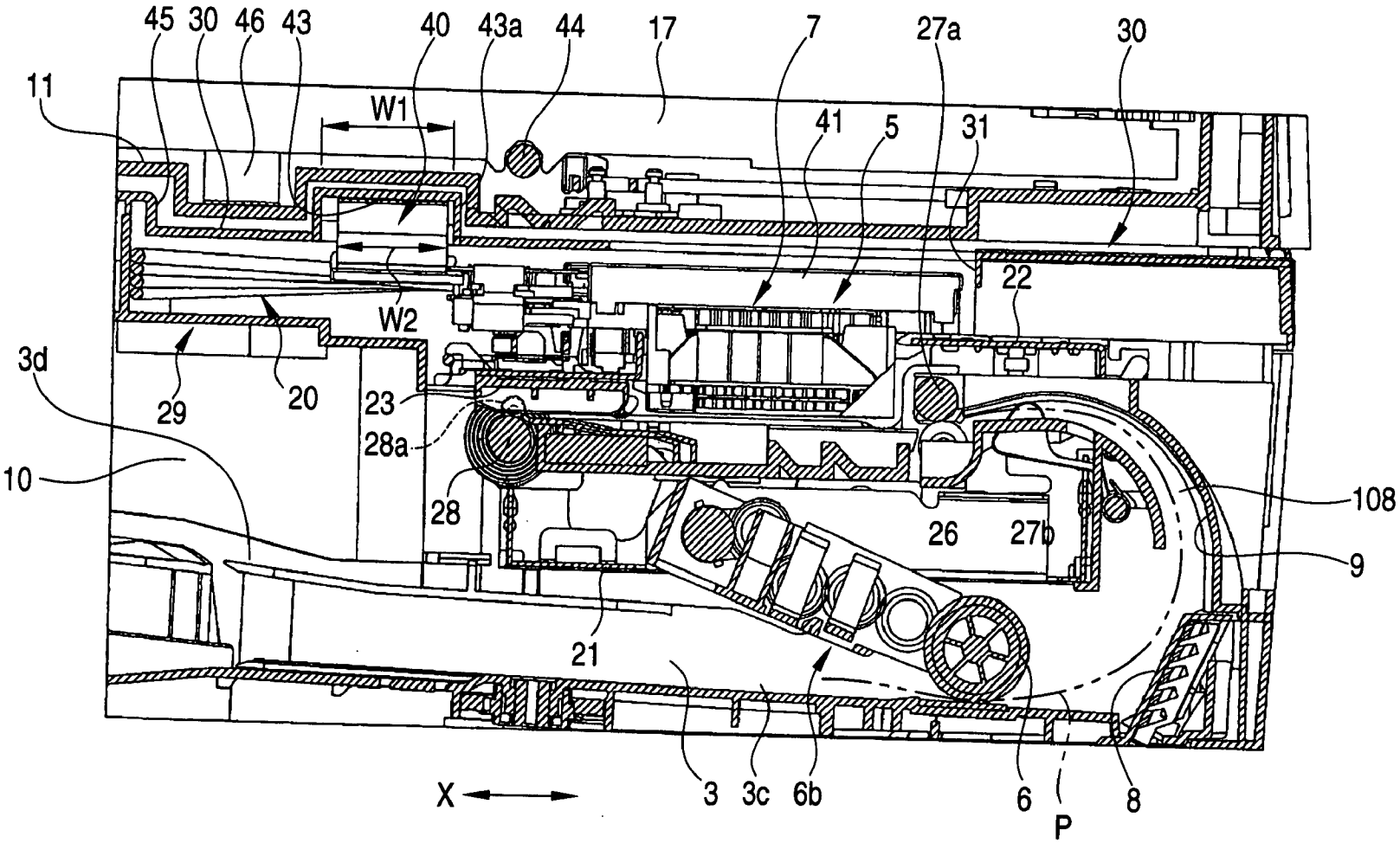
FIG. 8 is an enlarged cross-sectional side view taken along a line VIII-VIII in FIG. 3.

As shown in FIG. 8, the inkjet printer 2 is provided with the paper feeding cassette 3 thereunder. The paper feeding cassette 3 is inserted from the paper discharging port (opening) 10*a* so as to be capable of inserting and removing freely in the front-rear direction. The paper feeding cassette 3 is provided with a recess 3*c* for accommodating a recording paper in stack, and when the paper feeding cassette 3 is inserted, the recording paper in the recess 3*c* is disposed at the rear. In front of the paper feeding cassette 3, a tray 3*d* for receiving the recording paper recorded as described later is formed.

As shown in FIG. 8, there is disposed a paper feeding unit 6*b* above the paper feeding cassette 3, and the recording unit 7 is disposed above the paper feeding unit 6*b*. The paper feeding unit 6b is provided with the paper feeding roller 6*a* for feeding the recording paper in the paper feeding cassette 3 to the recording unit 7 separately one by one. Formed on the downstream side of the paper feeding unit 6*b* in the direction of transportation of the recording paper is a guiding channel 108 for guiding the recording paper from the rear of the paper feeding cassette 3 to the recording unit 7 formed in a curved shape.

Disposed on the downstream side of the guiding channel 108 in the direction of transportation of the recording paper are a transporting roller 27*a* and a nip roller 27*b* as shown in FIG. 8, and the transporting roller 27*a* and the nip roller 27*b* function as a pair of transporting rollers. The nip roller 27*b* is disposed under the transporting roller 27*a* for pressing and clamping the recording paper with respect to the transporting roller 27*a*, and the transporting roller 27*a* serves as a driving roller.

Provided on the downstream side of the transporting roller 27*a* and the nip roller 27*b* in the direction of transportation of the recording paper is the recording unit 7, and the platen 26 is disposed under the recording unit 7. When the recording paper is transported onto the platen 26, the image is formed by a recording head, described later, of the recording unit 7.

In addition, there are also provided the spur roller 28*a* and the paper discharging roller 28 for discharging the recording paper on which the image is formed on the downstream side of the recording unit 7 in the direction of transportation of the recording medium, and the spur roller 28*a* and the discharging roller 28 function as a pair of discharging rollers. The paper discharging roller 28 is rotated by a rotating force of, for example, a stepping motor, and the recording paper is discharged in a direction orthogonal to the width of the recording paper (in the sbu scanning direction) by the rotation of the paper discharging roller 28.

The spur roller 28*a* has a plurality of teeth therearound, and is formed into a teethed roller in which the tips of the respective teeth are pointed into an acute angle so as to come into point contact with a recording surface of the recording paper. The spur roller 28*a* is urged toward the paper discharging roller 28, and comes into contact with the recording paper when the recording paper is discharged by the rotation of the paper discharging roller 28, and rotates in association with discharge of the recording paper. Therefore, the paper discharging roller 28 serves as a driving roller.

Provided behind the opening 10*a* is the paper discharging unit (hollow cavity) 10 to which the recording paper is discharged from the recording unit 7 via the spur roller 28*a* and the paper discharging roller 28. The tray 3*d* of the paper feeding cassette 3 is disposed on the bottom of the hollow cavity 10, so that the recording paper recorded by the recording unit 7 is discharged onto the tray 3*d*.

Referring to above-described FIGS. 5, 6, 8, 22 and 23, the structure of the recording unit 7 will be described.

As shown in the figures, the recording unit 7 includes the recording head 4, and the recording head 4 is mounted on the carriage 5. The carriage 5 is guided by guide rails 22, 23 as the guiding unit so as to be capable of moving in the widthwise direction of the recording paper (main scanning direction).

Near the both ends of the guide rail 23, there are provided pulleys 23*a*, 23*b* as shown in FIG. 5, and the pulley 23*b* out of the pulleys 23*a*, 23*b* is connected to the carriage motor 25 as the head carrying unit so as to be operated in conjunction therewith. The endless belt 24 is wound around the pulleys 23*a*, 23*b*. The carriage 5 is connected to the endless belt 24.

Therefore, the carriage 5 reciprocates in the aforementioned widthwise direction (main scanning direction) along the guide rails 22, 23 on the platen 26 via the pulleys 23*a*, 23*b*, and the endless belt 24 according to the rotation of the carriage motor 25.

Since the transporting roller 27*a* out of the transporting roller 27*a* and the nip roller 27*b* serves as a driving roller, the guide rail 22 which is located on the side opposing to a joint portion with respect to tubes, described later, is formed so as to extend in parallel with the printer installation surface.

Since the discharging roller 28 out of the spur roller 28*a* and the paper discharging roller 28 serves as a driving roller, the guide rail 23 located on the side of the joint portion with respect to the tubes, described later, is formed into an L-shape in cross-section. The above-described carriage motor 25 is disposed on the side of the guide rail 23 formed into the L-shape.

These guide rails 22, 23 are formed respectively of metal and are formed into the L-shape in cross-section.

Figure 6:
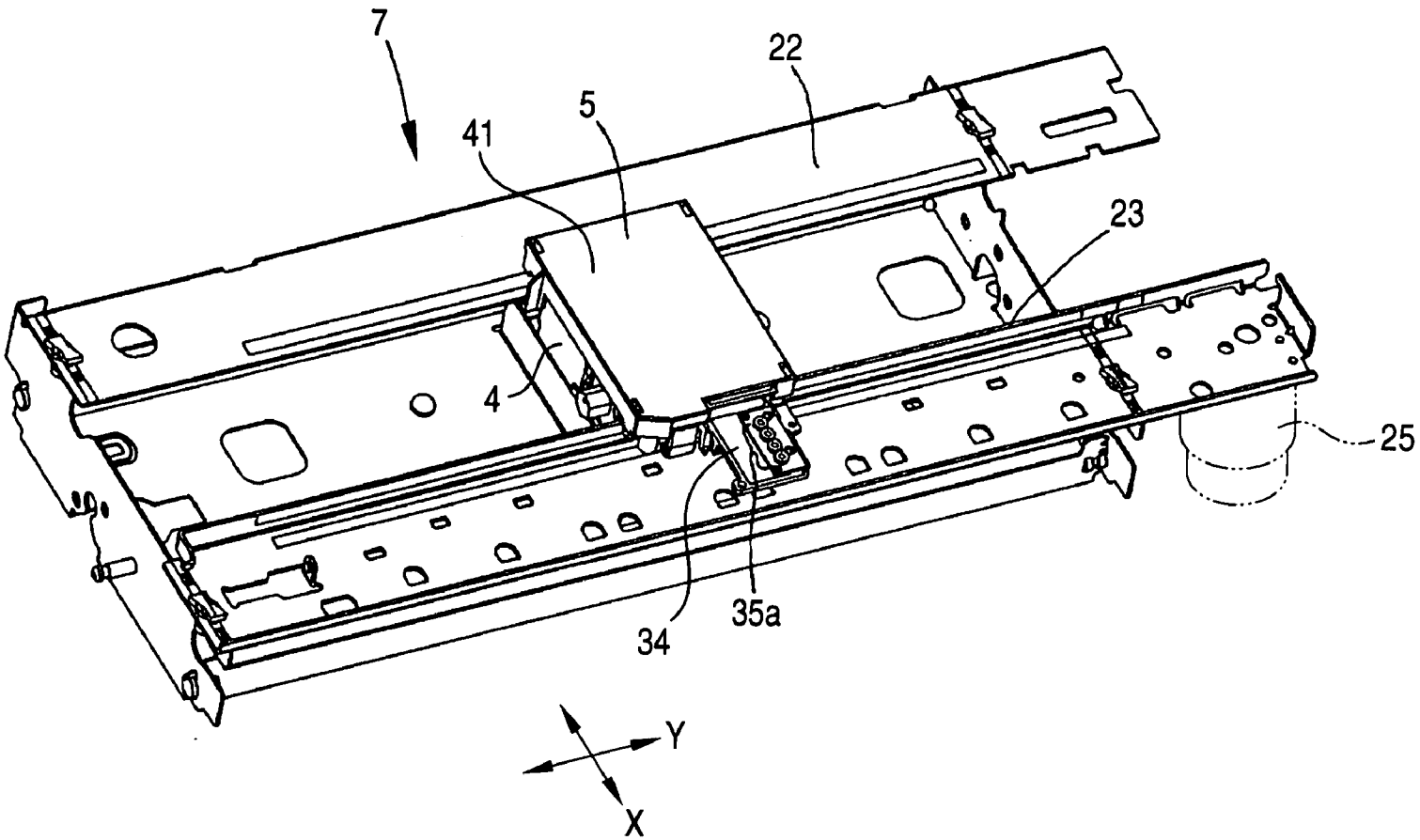
FIG. 6 is a perspective view of the carriage and the pair of the guide rails.
Figure 7:
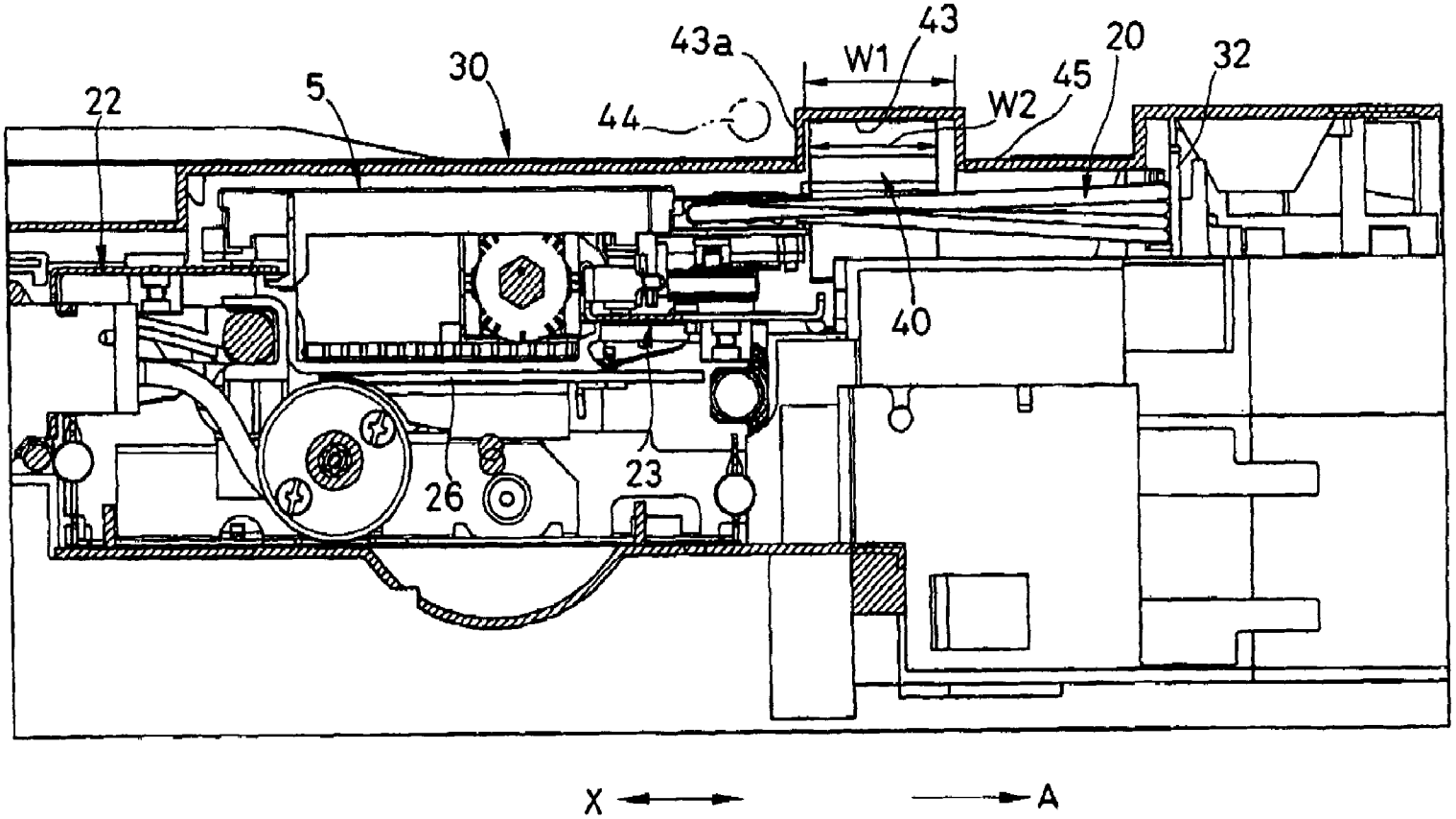
FIG. 7 is an enlarged cross-sectional side view taken along a line VII-VII in FIG. 3.
Figure 11:
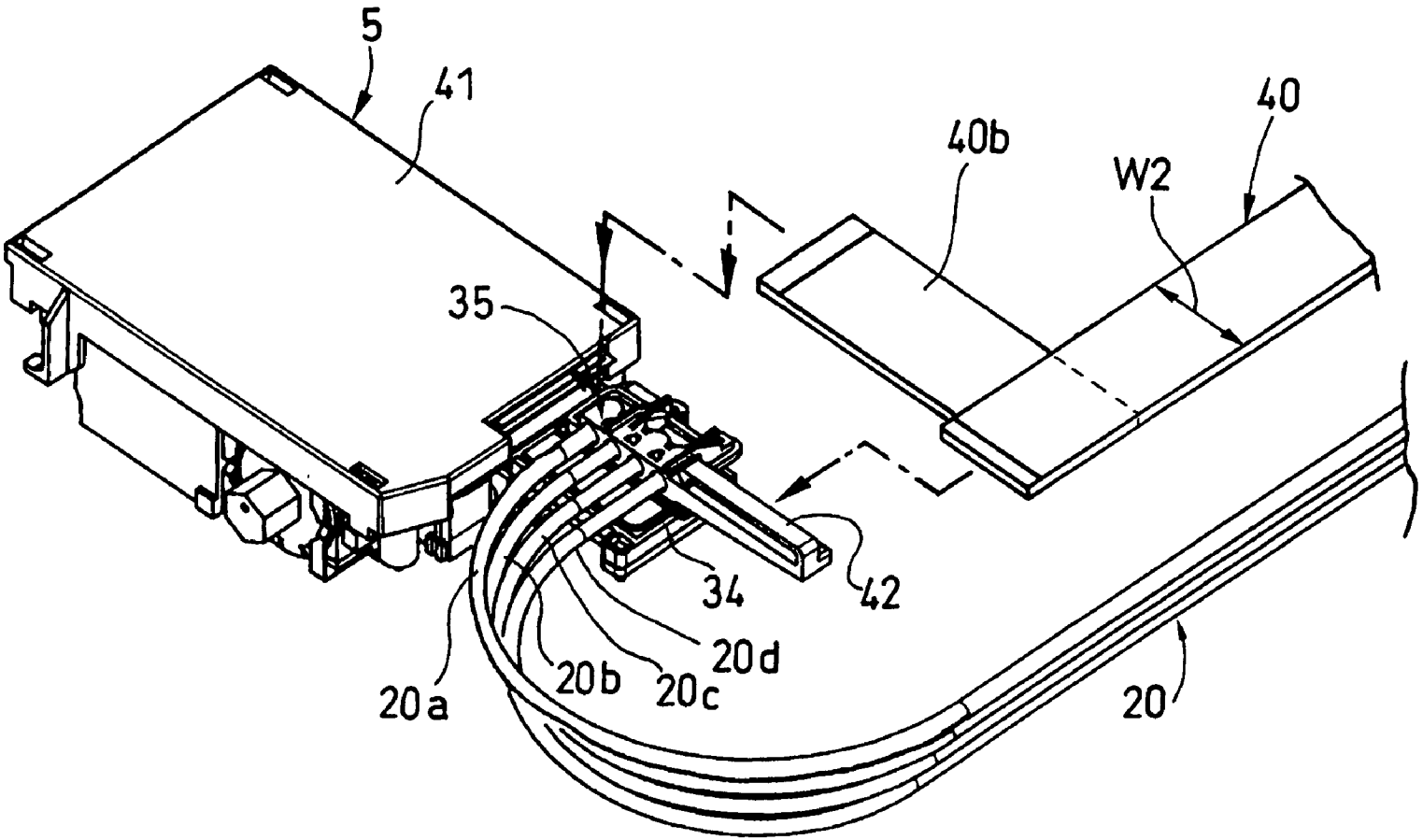
FIG. 11 is a perspective view showing a connecting portion of the ink supply tubes and the flexible flat cable with respect to the carriage.

Also, on the side end surface of the carriage in the direction of movement thereof and on the downstream side of the carriage 5 in the direction of transportation of the recording paper, four tube connecting ports 35*a* are provided as shown in FIG. 6. As shown in FIG. 11, these four tube connecting ports 35*a* are connected to ink tubes 20 at one ends thereof and the other ends of the ink tubes 20 are connected to respective ink cartridges as the ink storage.

The recording head 4 includes four parts for ejecting four different colors of ink, not shown. Correspondingly, the ink tube 20 flows ink of respective different colors, and supplies ink from the respective ink cartridges to the corresponding structures of the recording head 4.

The ink tube 20 is formed into four-tube plate of flexible member arranged in row and combined into a plate shape except for both ends thereof, and has flexibility in the direction of the thickness.

The ink tube 20 is connected to a side end surface of the recording head 4 in the direction of movement thereof and on the downstream side of the recording head 4 in the direction of transportation of the recording paper.

Subsequently, the outline of the recording operation of the inkjet printer 2 according to this embodiment will be described.

As shown in FIG. 3, the recording paper stacked on the paper feeding cassette 3 is fed one by one separately by the rotation of the paper feeding roller 6 of the paper feeding unit 6*b* which comes into abutment with the upper surface thereof. The fed recording paper is fed through the guiding channel 108 for guiding to the recording unit 7 to the transporting roller 27*a* and the nip roller 27*b*. The transporting roller 27*a* is rotated and guides the fed recording paper to a predetermined recording position on the platen 26.

When the recording paper is guided to the recording position, the carriage motor 25 is driven, the carriage 5 is moved along the guide rails 22, 23, and scanning for determining the recording position in this direction of movement is performed. During this movement, the recording head 4 is driven, and ink liquid is ejected to be attached to a predetermined position on the recording paper, whereby recording of the image which corresponds to one scanning operation is performed.

Subsequently, the recording paper is transported by a predetermined extent which corresponds to the recording width for one scanning operation, and then the carriage 5 is moved again along the guide rails 22, 23, whereby the image formation for the next one scanning operation is performed.

In this manner, when the recording on a predetermined area on the recording paper is completed, the recording paper is discharged on the tray 3*d* of the paper feeding cassette 3 by the spur roller 28*a* and the paper discharging roller 28.

In the inkjet printer 3 according to this embodiment described above, since the ink tubes 20 are connected to the side end surface of the recording head 4 in the direction of movement thereof and on the downstream side of the recording head 4 in the direction of transportation of the recording paper, when the recording head 4 is moved, the ink tubes 20 are prevented from being located above the platen 26 within the range of movement of the recording head 4, that is, between the guide rails 22, 23.

Therefore, since the ink tubes 20 are not placed between the guide rails 22, 23 when the recording head 4 moves, when the recording paper is jammed and an attempt is made to remove the jammed recording paper on the platen 26, the ink tubes 20 do not impair the operation, whereby removal of jammed paper can easily be performed.

In this embodiment, since the guide rail 23 located on the side of the recording head 4 where the joint-portion with respect to the ink tubes 20 is formed into the L-shape in cross-section, the weight balance of the recording head 4 and the carriage motor 25 with respect to the center of gravity of the inkjet printer 3 is improved, and hence the moment is decreased. Consequently, rattling of the recording head 4 is prevented, and an accurate image can be formed on the recording medium. Since the guide rail 23 is formed into L-shape in cross-section, formation of the guide rail 23 is facilitated, thereby achieving cost reduction of the guide rail.

In the present embodiment, since the carriage motor 25 is disposed on the side of the joint portion between the recording head 4 and the tubes 20, the weight balance with respect to the center of gravity of the inkjet printer 3 is improved, and the moment is reduced, as in the case described above and an accurate image can be formed on the recording paper.

Also, in the present embodiment, when the transporting roller 27*a* and the nip roller 27*b* are disposed on the upstream side of the recording head 4 in the direction of transportation of the recording paper, and one of the transporting rollers 27*a* and the nip roller 27*b* which is located on the side of the recording head 4 serves as a driving roller, the guide rail 22 located on the side of the recording head 4 opposing to the joint portion with respect to the ink tubes 20 is formed so as to extend in parallel with the printer installation surface, whereby the height of the printer can be reduced in comparison with the case in which the other roller is employed as a driving roller, and hence the thickness of the printer can be reduced.

In this embodiment, since the spur roller 28*a* and the discharging roller 28 are disposed below the guide rail 23 formed into the L-shaped in cross-section, and the discharging roller 28 opposing to the spur roller 28*a* located on the side of the guide rail 23 formed into the L-shaped serves as a driving roller, the height of the printer can be reduced in comparison with the case in which the opposing roller is the driving roller, whereby the thickness of the printer can be reduced.

In the inkjet printer 2 configured as described above, the guiding unit is a pair of guide rails 22, 23, and the guide rail 23 located on the side where a joint portion between the recording head and the tube is located is formed into an L-shape in cross-section.

Since the guide rail 23 located on the side of the joint portion between the recording head and the tube is formed into L-shape in cross-section, the weight balance of the recording head and the head carrying unit with respect to the center of gravity of the printer 2 is improved, and hence the moment is decreased. Consequently, rattling of the recording head is prevented and an accurate image can be formed on the recording medium. Since the guide rail 23 is formed into L-shape in cross-section, formation of the guide rail may be facilitated, thereby achieving cost reduction of the guiding unit.

In the inkjet printer 2 configured as described above, the head carrying unit is disposed on the side where the joint portion between the recording head and the tube is located.

Since the head carrying unit is disposed on the side of the joint portion between the recording head and the tube, the weight balance is improved, and the moment is reduced, whereby rattling of the recording head 4 is prevented, and an accurate image can be formed on the recording medium.

In the inkjet printer 2 configured as described above, the pair of transporting rollers 27*a*, 27*b* are disposed on an upstream side of the recording head 4 in the direction of transportation of the recording medium, one of the pair of transporting rollers which is located on the side of the recording head serves as a driving roller, and the guide rail 22 which is located on the side of the recording head opposing to the joint portion with respect to the tube is formed to extend in parallel with a printer installation surface.

When the pair of transporting rollers 27*a*, 27*b* are disposed on the upstream side of the recording head in the direction of transportation of the recording medium and one of the transporting rollers located on the side of the recording head serves as a driving roller, since the guide rail 22 located on the side of the recording head opposing to the joint portion with respect to the tube is formed so as to extend in parallel with the printer installation surface, the height of the printer can be reduced in comparison with the case in which the other roller is employed as the driving roller, and hence the thickness of the printer can be reduced.

In the inkjet printer 2 configured as described above, the pair of discharging rollers 28*a*, 28 are disposed below the guide rail 23 formed into the L-shape in cross-section, and one of the pair of discharging rollers which opposes to the roller 28*a* located on the side of the L-shaped guide rail serves as a driving roller.

Since the pair of discharging rollers 28*a*, 28 are disposed below the guide rail 23 formed into the L-shape in cross-section, and one of the discharging rollers opposing to the roller located on the side of the guide rail formed into the L-shape serves as a driving roller, the height of the printer can be reduced in comparison with the case in which the other roller is the driving roller, whereby the thickness of the printer can be reduced.

In the above-described embodiment, the present invention is applied to the multifunction apparatus. However, it can also be applied to the image recording apparatus provided with an inkjet recording head.

In the above-described embodiment, the structure in which the ink cartridges 19*a*-19*d* containing four colors of ink (BK, C, M, Y) are stored in the ink storage 15 has been described. However, the structure in which ink is directly stored in the ink storage 15 may also be applicable instead of the ink cartridge 19. In this case, the structure in which ink is directly replenished into the ink storage 15 may be employed.

In the aforementioned embodiment, the case in which the recording paper is used as the recording medium has been described. However, the invention is not limited thereto, and various sheets such as a laminated sheet including resin and paper maybe applied.

What is claimed is:

1. An image recording apparatus comprising:

a recording apparatus body;

a carriage being capable of reciprocating in a predetermined direction in the recording apparatus body;

a recording head mounted on the carriage and being capable of recording an image on a recording medium by selectively ejecting ink drops thereon;

joint portions disposed on the carriage and having paths leading to the recording head;

an ink storage disposed in the recording apparatus body separately from the recording head;

a plurality of flexible ink supply tubes connected between the ink storage and the joint portions for supplying ink from the ink storage to the recording head; and an intermediate fixing portion provided in the recording apparatus body and fixing the plurality of ink supply tubes, wherein the plurality of ink supply tubes between the intermediate fixing portion and the joint portions are disposed independently and bent at midsections thereof, and a direction of arrangement of the plurality of ink supply tubes at the midsections thereof extending toward the intermediate fixing portion and a direction of arrangement of the plurality of ink supply tubes at the midsections thereof extending toward the joint portions are differentiated, and wherein the plurality of flexible ink supply tubes extend from the joint portions in a direction substantially parallel to the predetermined direction wherein the plurality of ink supply tubes are arranged substantially along a horizontal direction at the joint portions, and wherein the plurality of ink supply tubes are arranged substantially along a vertical direction at the intermediate fixing portion.

2. The image recording apparatus according to claim 1, wherein the ink supply tubes extend from the intermediate fixing portion in one direction in parallel with a direction of movement of the carriage, extend in a direction substantially opposite to the one direction via the bent midsections and are connected to a connecting strip of the carriage.

3. The image recording apparatus according to claim 2, wherein a position of the intermediate fixing portion along the direction of movement of the carriage is a position where a bending radius of the ink supply tubes is maintained to be a predetermined value or more when the carriage is moved to one end in the direction of movement, and is a position where the bending radius of the ink supply tubes is maintained to be the predetermined value or more when the carriage is moved to the other end in the direction of movement.

4. The image recording apparatus according to claim 1, wherein a difference between the direction of arrangement of the plurality of ink supply tubes at the midsections thereof extending toward the intermediate fixing portion and the direction of arrangement of the plurality of ink supply tubes at the midsections thereof extending toward the joint portions is set to a range between 30° and 120°.

5. The image recording apparatus according to claim 1, wherein the plurality of ink supply tubes are arranged in such a manner that one ink supply tube having a largest bending rigidity out of the plurality of ink supply tubes is bent to have a largest radius of curvature at the bent midsection thereof.

6. The image recording apparatus according to claim 5, wherein the ink supply tube having the largest bending rigidity is arranged at one of a lowermost position and an uppermost position at the intermediate fixing portion.

7. The image recording apparatus according to claim 5, wherein an arranged level of the ink supply tube having the largest bending rigidity out of the plurality of ink supply tubes arranged substantially in a vertical direction at the intermediate fixing portion is shifted upward with respect to a horizontal level passing through centerlines of the plurality of ink supply tubes at the joint portions, and arranged levels of the remaining plurality of ink supply tubes are equal to or shifted downward from the horizontal level.

8. The image recording apparatus according to claim 5, wherein an arranged level of the ink supply tube having the largest bending rigidity out of the plurality of ink supply tubes arranged substantially in a vertical direction at the intermediate fixing portion is shifted downward with respect to a horizontal level passing through centerlines of the plurality of ink supply tubes at the joint portions, and arranged levels of the remaining plurality of ink supply tubes are equal to or shifted upward from the horizontal level.

9. The image recording apparatus according to claim 5, wherein the number of the ink supply tubes is four and only one of the ink supply tubes is formed to have a high bending rigidity.

10. The image recording apparatus according to claim 1, wherein arranged levels of all the plurality of ink supply tubes arranged substantially in the vertical direction at the intermediate fixing portion are shifted upward or downward with respect to a level of the joint portions.

11. The image recording apparatus according to claim 1, wherein lengths of all the plurality of ink supply tubes are set to the same length.

12. The image recording apparatus according to claim 1, further comprising resilient communicating members interposed between ends of the respective ink supply tubes and the respective joint portions.

13. The image recording apparatus according to claim 1, wherein the plurality of ink supply tubes are separated into two groups by adequate number, and the ink supply tubes of each separated group are arranged so that projecting sides of the bent midsections are oriented in opposite directions along a reciprocating direction of the carriage.

14. The image recording apparatus according to claim 1, wherein arranged positions of the joint portions are shifted in an opposite direction to a projecting direction of the bent midsections of the ink supply tubes with respect to a widthwise center of the carriage.

15. The image recording apparatus according to claim 1, wherein a flexible flat cable for transmitting recording signals to the recording head is connected to the recording apparatus body and the carriage without extending along the plurality of ink supply tubes.

16. The image recording apparatus according to claim 15, wherein the flexible flat cable is fixed by a clamping unit and a recording head cover disposed at the joint portions.

17. The image recording apparatus according to claim 15, wherein the flexible flat cable is disposed in a movable range of the ink supply tubes in association with a reciprocal movement of the carriage.

18. The image recording apparatus according to claim 17, wherein the recording apparatus body is provided with an upper cover body and a lower cover body for covering above and below a space of the movable range of the ink supply tubes, a midsection of the flexible flat cable is bent so as to be inverted upside down in the space between the upper and lower cover bodies, and an upper half of the flexible flat cable is adapted to be slidable along a downward opened guiding groove formed on the upper cover body.

19. The image recording apparatus according to claim 18, wherein a guide shaft of an image reading unit is disposed above the upper cover body adjacently along the downward opened guiding groove formed on the upper cover body.

20. The image recording apparatus according to claim 18, wherein an upward opened second guiding groove is formed above the upper cover body so as to extends in parallel with the downward opened guiding groove formed on the upper cover body, and the flexible flat cable is disposed along a longitudinal direction of the second guiding groove.

21. The image recording apparatus according to claim 20, wherein the second guiding groove is formed on a bottom wall of the image reading unit.

22. The image recording apparatus according to claim 15, wherein projecting directions of the bent midsections of the plurality of ink supply tubes and of the bent midsection of the flexible flat cable are set to be opposite directions from each other along reciprocal movement directions of the carriage.

23. An image recording apparatus comprising:

a carriage being capable of reciprocating in a predetermined direction;

a recording head mounted on the carriage and being capable of recording an image on a recording medium by selectively ejecting ink drops thereon;

an ink storage disposed separately from the recording head;

a conveying unit capable of conveying the recording medium through a recording area in a conveying direction crossing the predetermined direction;

joint portions having paths leading the recording head, and disposed on the carriage in a downstream position from the recording head in the conveying direction; and a plurality of flexible ink supply tubes connected between the ink storage and the joint portions for supplying ink from the ink storage to the recording head, the tubes connected to a side surface of the joint portions which face the predetermined direction, wherein the joint portions are aligned substantially along a horizontal direction such that the plurality of flexible ink supply tubes are arranged substantially along the horizontal direction at the joint portions.

24. The image recording apparatus according to claim 23, further comprising a pair of guide rails, wherein the guide rail located on a side where the joint portions between the recording head and the tubes are located is formed into an L-shape in cross-section.

25. The image recording apparatus according to claim 24, wherein the conveying unit comprises a pair of transporting rollers for transporting the recording medium in the conveying direction, and the pair of transporting rollers are disposed on an upstream side of the recording head in the conveying direction, one of the pair of transporting rollers which is located on a side of the recording head serves as a driving roller, and the guide rail which is located on a side opposite to the side of the joint portions is formed to extend in parallel with a printer installation surface.

26. The image recording apparatus according to claim 24, wherein the conveying unit comprises a pair of discharging rollers for discharging the recording medium on which the image is formed by the recording head, and the pair of discharging rollers are disposed below the guide rail formed into the L-shape in cross-section, and one of the pair of discharging rollers which opposes to the roller located on a side of the L-shaped guide rail serves as a driving roller.

27. The image recording apparatus according to claim 23, further comprising a head carrying unit that causes a reciprocating movement of the recording head and is disposed on a side where the joint portions between the recording head and the tubes are located.

28. The image recording apparatus according to claim 23, wherein the conveying unit comprises a pair of transporting rollers for transporting the recording medium to the recording area and a pair of discharging rollers for discharging the recording medium on which the image is formed by the recording head from the recording area.

29. The image recording apparatus according to claim 23, wherein a direction of arrangement of the plurality of ink supply tubes at the midsections thereof extending toward an intermediate fixing portion and a direction of arrangement of the plurality of ink supply tubes at the midsections thereof extending toward the joint portions are differentiated.

30. An image recording apparatus comprising:

a carriage being capable of reciprocating in a predetermined direction;

a recording head mounted on the carriage and being capable of recording an image on a recording medium by selectively ejecting ink drops thereon;

an ink storage disposed separately from the recording head;

a conveying unit capable of conveying the recording medium through a recording area in a conveying direction crossing the predetermined direction;

joint portions having paths leading the recording head, and disposed on the carriage in a downstream position from the recording head in the conveying direction; and a plurality of flexible ink supply tubes connected between the ink storage and the joint portions for supplying ink from the ink storage to the recording head, the tubes connected to a side surface of the joint portions which face the predetermined direction, wherein the plurality of flexible ink supply tubes are arranged substantially along a horizontal direction at the joint portions, wherein the plurality of ink supply tubes are arranged substantially along a vertical direction at the intermediate fixing portion.

31. An image recording apparatus comprising:

a recording apparatus body;

a carriage being capable of reciprocating in a predetermined direction in the recording apparatus body;

a recording head mounted on the carriage and being capable of recording an image on a recording medium by selectively ejecting ink drops thereon;

joint portions disposed on the carriage and having paths leading to the recording head;

an ink storage disposed in the recording apparatus body separately from the recording head;

a plurality of flexible ink supply tubes connected between the ink storage and the joint portions for supplying ink form the ink storage to the recording head; and an intermediate fixing portion provided in the recording apparatus body and fixing the plurality of ink supply tubes, wherein the plurality of in supply tubes between the intermediate fixing portion and the joint portions are disposed independently and bent at midsections thereof, and a direction of arrangement of the plurality of in supply tubes at the midsections thereof extending toward the intermediate fixing portions and a direction of arrangement of the plurality of ink supply tubes at the midsections thereof extending toward the joint portions are differentiated, and wherein the joint portions are aligned substantially along a horizontal direction such that the plurality of ink supply tubes are arranged substantially along the horizontal direction at the joint portions.

32. An image recording apparatus comprising:

a recording apparatus body;

a carriage being capable of reciprocating in a predetermined direction in the recording apparatus body;

a recording head mounted on the carriage and being capable of recording an image on a recording medium by selectively ejecting ink drops thereon;

joint portions disposed on the carriage and having paths leading to the recording head;

an ink storage disposed in the recording apparatus body separately from the recording head;

a plurality of flexible ink supply tubes connected between the ink storage and the joint portions for supplying ink form the ink storage to the recording head; and an intermediate fixing portion provided in the recording apparatus body and fixing the plurality of ink supply tubes, wherein the plurality of in supply tubes between the intermediate fixing portion and the joint portions are disposed independently and bent at midsections thereof, and a direction of arrangement of the plurality of in supply tubes at the midsections thereof extending toward the intermediate fixing portions and a direction of arrangement of the plurality of ink supply tubes at the midsections thereof extending toward the joint portions are differentiated, wherein the plurality of ink supply tubes are arranged substantially along a horizontal direction at the joint portions, and wherein the plurality of ink supply tubes are arranged substantially along a vertical direction at the intermediate fixing portion.

* * * * *

UNITED STATES PATENT AND TRADEMARK OFFICE

CERTIFICATE OF CORRECTION

PATENT NO. : 7,537,322 B2
APPLICATION NO. : 11/071315
DATED : May 26, 2009
INVENTOR(S) : Kan Ishikawa et al.

It is certified that error appears in the above-identified patent and that said Letters Patent is hereby corrected as shown below:

On the Title page, References Cited section (56), U.S. Patent Documents:
Please insert the following reference: --2002/236180 9/2002 Hiramatusu et al--

On the Title page, References Cited section (56), Foreign Patent Documents:
Please insert the following references:
--JP 11-268288 10/1995
JP 2001-260382 09/2001
JP 2002-331654 11/2002
JP 2001-270132 10/2001
JP 09-323430 12/1997
JP 05-131647 05/1993
JP 2001-171096 06/2001--

On the Title page, References Cited section (56), Other Publications:
Please insert the following reference: --Notification of Reason for Refusal dated May 28, 2008 in Application No. JP2004-064631 and English translation thereof.--

In Column 26, Claim 31, Line 16:
Please replace "in supply" with --ink supply--

In Column 26, Claim 32, Line 42:
Please replace "form the ink" with --from the ink--

In Column 26, Claim 32, Lines 46 and 49-50:
Please replace "in supply" with --ink supply--

Signed and Sealed this

Thirteenth Day of July, 2010

David J. Kappos

David J. Kappos
*Director of the United States Patent and Trademark Office*